US010710270B1

(12) United States Patent
Lincoln

(10) Patent No.: US 10,710,270 B1
(45) Date of Patent: Jul. 14, 2020

(54) ATTACHING OBJECTS MADE OF DISSIMILAR MATERIALS USING A MOLDED ATTACHMENT BLOCK

(71) Applicant: Timothy Martin Lincoln, Gonzales, CA (US)

(72) Inventor: Timothy Martin Lincoln, Gonzales, CA (US)

( * ) Notice: Subject to any disclaimer, the term of this patent is extended or adjusted under 35 U.S.C. 154(b) by 234 days.

(21) Appl. No.: 16/005,691

(22) Filed: Jun. 12, 2018

(51) Int. Cl.

| | |
|---|---|
| ***B26B 7/00*** | (2006.01) |
| ***E04C 5/08*** | (2006.01) |
| ***B28B 1/26*** | (2006.01) |
| ***B28B 7/00*** | (2006.01) |

(52) U.S. Cl.
CPC ..... *B28B 1/266* (2013.01); *B28B 7/0014* (2013.01); *B28B 2007/005* (2013.01); *E04C 5/08* (2013.01); *E04C 5/085* (2013.01)

(58) Field of Classification Search
CPC ..... E02D 5/50; E04C 5/085
See application file for complete search history.

(56) References Cited

U.S. PATENT DOCUMENTS

2007/0125017 A1* 6/2007 Blount ..... E04C 5/085 52/223.1

* cited by examiner

*Primary Examiner* — Peter L Vajda
*Assistant Examiner* — Paul Spiel
(74) *Attorney, Agent, or Firm* — Ashok Tankha

(57) ABSTRACT

A method for attaching a first object to one or more second objects of dissimilar materials, without any bonding material, using a molded attachment block is provided. Anchoring grooves are created and a constrained assembly is positioned at opposing sections on a surface of the first object. A tension is generated in tension bearing members anchored in the anchoring grooves and extended along a length of the constrained assembly. The constrained assembly is constricted between mold side members positioned perpendicular to the mold end members. The tension bearing members are clamped between bolt assemblies. A viscous liquid is poured and cured on the constrained assembly, the tension bearing members, the anchoring grooves, and the bolt assemblies for creating the molded attachment block with opposing ends of the threaded members of the constrained assembly extending outwardly from the molded attachment block for attachment to second objects without any bonding material.

15 Claims, 19 Drawing Sheets

ATTACHING OBJECTS MADE OF DISSIMILAR MATERIALS USING A MOLDED ATTACHMENT BLOCK

BACKGROUND

Objects made of dissimilar materials are typically attached to each other using a bonding material, for example, glue, adhesives, mortar, etc. Consider an example where tiles are attached to a surface, for example, a wall, for covering wall surfaces, for constructing standalone structures to support loads, for partitioning structures, for ornamental purposes, etc. Gaps between adjacent tiles to be attached are filled with the bonding material. The assembly of the adjacent tiles forms a tile assembly that is primarily strengthened by the bonding material. Over time, the tile assembly may lose its strength due to a change in the properties of the bonding material caused, for example, by a change in climate, a corrosive environment, or variable loads. Replacing the bonding material or clipping the tiles may damage the tile assembly or mar the aesthetic appearance of the tile assembly.

To avoid the problems associated with using the bonding material for attaching objects of dissimilar materials, some methods use a mechanical means for attaching the objects. However, the mechanical means, for example, ridges, grooves, clips, screws, bolts, nails, etc., may also damage the objects, for example, the tiles, and mar the aesthetic appearance of the tiles. Moreover, the mechanical means are typically exposed to an external environment and require continuous maintenance. The maintenance comprises a regular and laborious manual examination of the condition of the mechanical means that attach each of the tiles to a surface, for example, a wall. Therefore, there is a need for a modular structure that encases the mechanical means, retains tension in the encased mechanical means under different conditions of strain experienced by the mechanical means, and protects the mechanical means from the external environment to reduce time and effort involved in maintenance of each of the mechanical means on a regular basis. Moreover, there is a need for one or more connecting elements, for example, hooks, threaded rods, flat bars, etc., that extend from the modular structure and facilitate attachment of an object to another object of a dissimilar material.

Hence, there is a long felt but unresolved need for a method for attaching a first object made of a first material to one or more second objects made of one or more of multiple second materials that are dissimilar to the first material of the first object, using a molded attachment block, that is, a modular structure, and without using any bonding material and without damaging the surface and aesthetic appearance of the first object.

SUMMARY OF THE INVENTION

This summary is provided to introduce a selection of concepts in a simplified form that are further disclosed in the detailed description of the invention. This summary is not intended to determine the scope of the claimed subject matter.

The method disclosed herein addresses the above recited need for attaching a first object made of a first material to one or more second objects made of one or more of multiple second materials that are dissimilar to the first material of the first object, using a molded attachment block, that is, a modular structure, and without using any bonding material and without damaging the surface and aesthetic appearance of the first object. The method disclosed herein comprises assembling the molded attachment block and attaching one or more second objects made of one or more second materials dissimilar to the first material of the first object, to a surface of the first object using the assembled molded attachment block. The molded attachment block encases mechanical means comprising anchoring grooves, tension bearing members, wire deflector plates, mold end members, threaded members, mold side members, etc., retains tension in the encased mechanical means under different conditions of strain experienced by the mechanical means, and protects the mechanical means from an external environment, thereby reducing time and effort involved in maintenance of each of the mechanical means on a regular basis.

In the method disclosed herein, anchoring grooves are created at opposing sections on a surface of the first object made of the first material. The anchoring grooves anchor tension bearing members on the first object. A constrained assembly comprising mold end members and threaded members is positioned proximal to the created anchoring grooves at the opposing sections on the surface of the first object. The mold end members comprise openings for receiving and perpendicularly engaging opposing ends of the threaded members. The tension bearing members are extended from the created anchoring grooves in opposing directions along a length of the constrained assembly via the mold end members. A tension is generated in the extended tension bearing members using a tensioning device. Mold side members are positioned perpendicular to the mold end members of the constrained assembly and along the length of the constrained assembly on the surface of the first object. The constrained assembly is constricted between the mold side members using clamping devices that are removably positioned on the mold side members. The extended tension bearing members, under the generated tension, are clamped between at least four bolt assemblies positioned above the surface of the first object within the constrained assembly for gripping the extended tension bearing members. A viscous liquid is poured on the constrained assembly, the extended tension bearing members, the anchoring grooves, and the bolt assemblies, and cured for creating the molded attachment block with the opposing ends of the threaded members of the constrained assembly extending outwardly from the molded attachment block. The clamping devices, and in an embodiment, the mold side members are removed from the created molded attachment block after the poured viscous liquid is cured. Ends of the extended tension bearing members that extend outwardly from the created molded attachment block are cut. The opposing ends of the threaded members extending from the created molded attachment block allow attachment of one or more second objects made of one or more second materials dissimilar to the first material of the first object to the surface of the first object without any bonding material.

BRIEF DESCRIPTION OF THE DRAWINGS

The foregoing summary, as well as the following detailed description of the invention, is better understood when read in conjunction with the appended drawings. For illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF THE INVENTION

Figure 1:
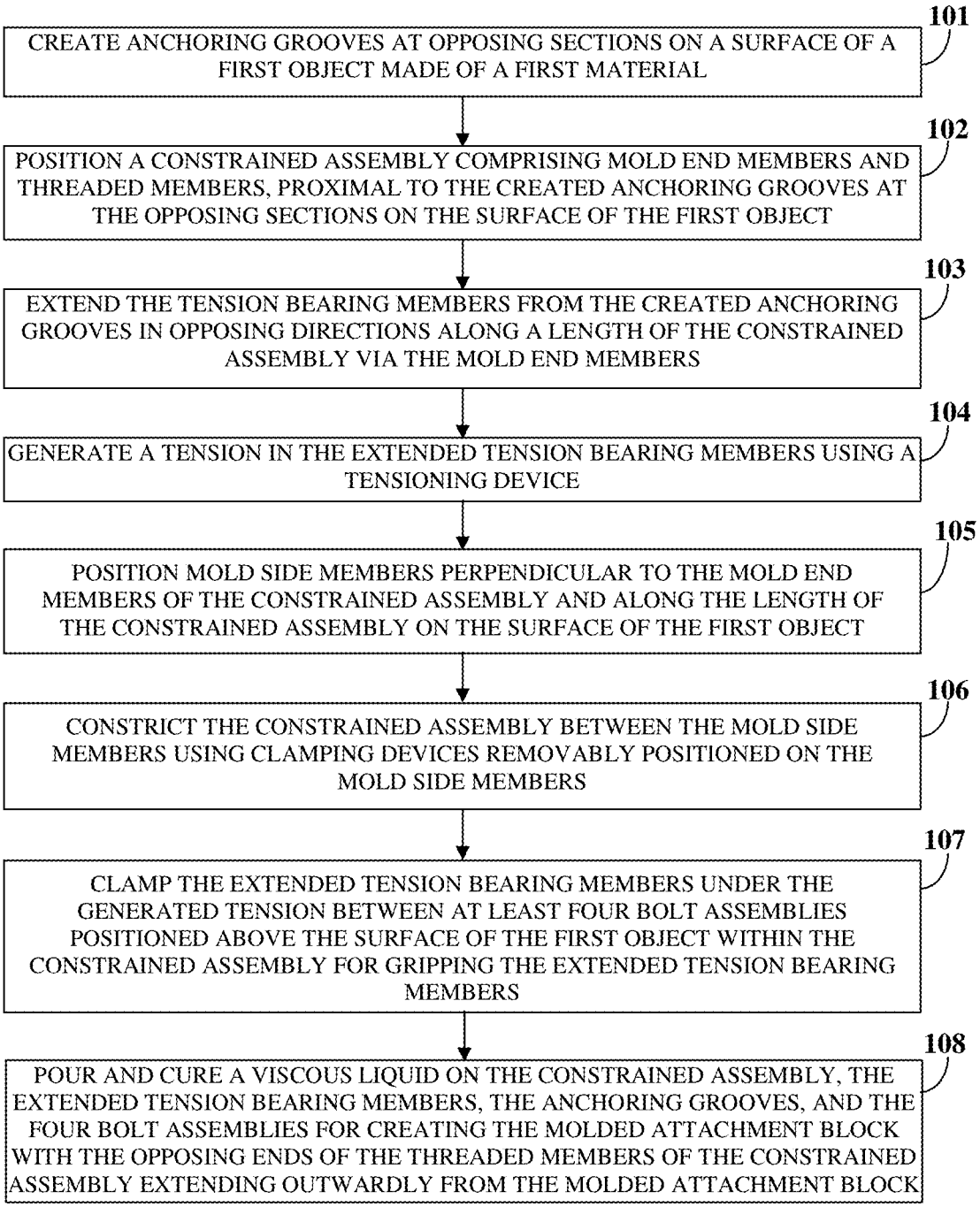
FIG. 1 illustrates a method for attaching a first object made of a first material to one or more second objects made of one or more of multiple second materials dissimilar to the first material of the first object without any bonding material, using a molded attachment block.
Figure 15:
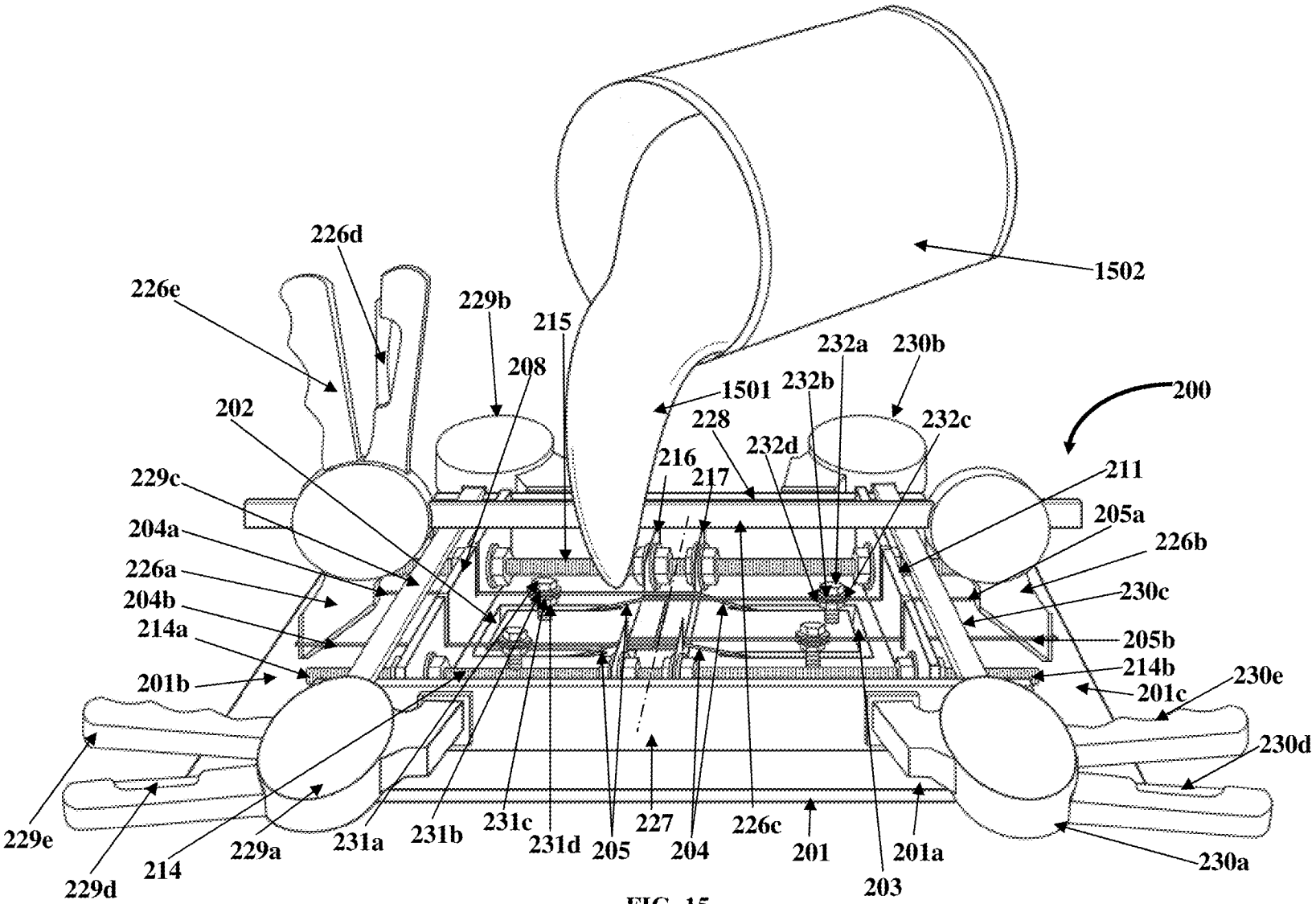
FIG. 15 exemplarily illustrates a top perspective view showing pouring of a viscous liquid on the assembly comprising the constrained assembly, the extended tension bearing members, the anchoring grooves, and bolt assemblies positioned above the surface of the first object, for creating a molded attachment block.
Figure 16A:
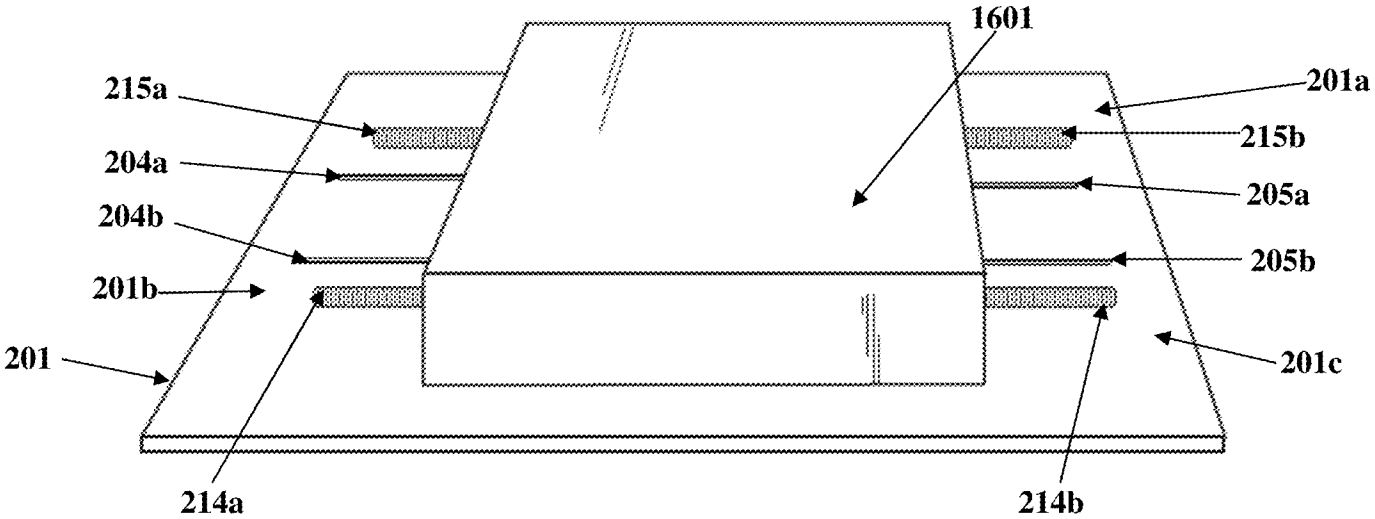
FIGS. 16A-16B exemplarily illustrate top perspective views of the molded attachment block created on curing of the poured viscous liquid shown in FIG. 15, showing opposing ends of threaded members of the constrained assembly extending from the molded attachment block.
Figure 16B:
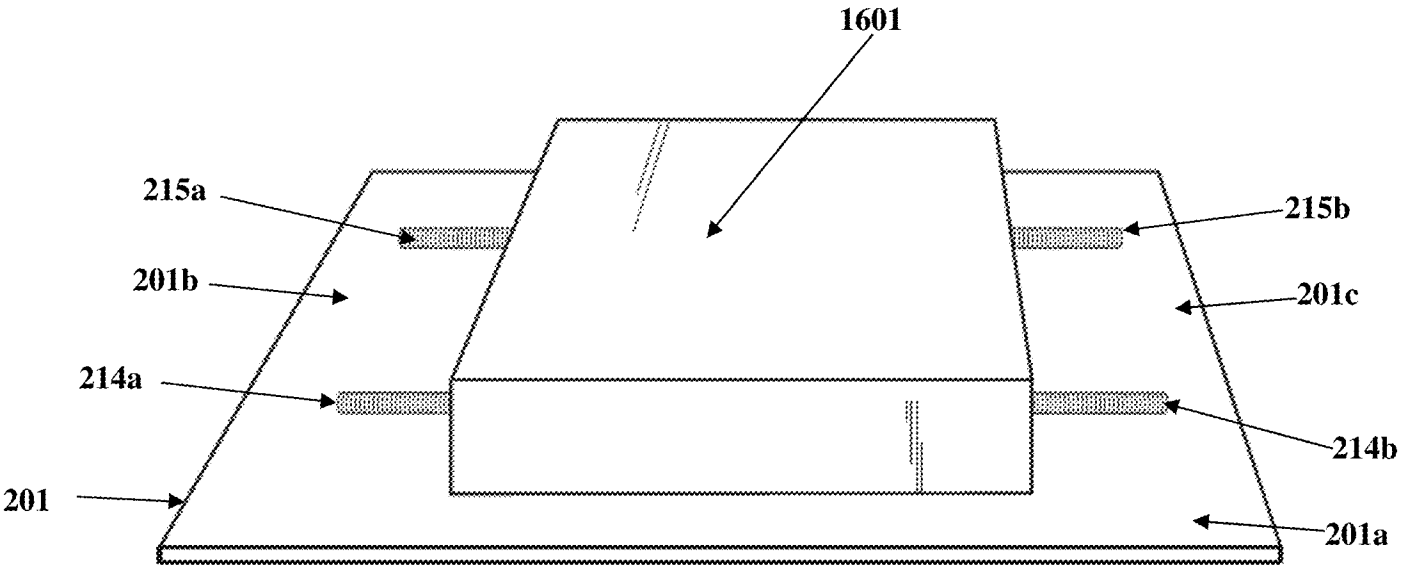

FIG. 1 illustrates a method for attaching a first object 201 exemplarily illustrated in FIGS. 2-4 and FIGS. 7-18, made of a first material to one or more second objects made of one or more of multiple second materials dissimilar to the first material of the first object 201, without any bonding material, for example, an adhesive, a chemical bonding material, etc., using a molded attachment block 1601 exemplarily illustrated in FIGS. 16A-16B. As used herein, "first object" refers to any tangible article or item, for example, a tile, a block, a pipe, etc., made of a first material that can be attached to another object, that is, a second object made of a second material similar or dissimilar to the first material. The first object 201 is, for example, a flat object, a cylindrical object, or any object having a constant surface geometry. As used herein, "constant surface geometry" refers to a geometry where a surface is constant and uniform and does not have abrupt protrusions that preclude creation of the molded attachment block 1601 on a surface 201*a*, for example, a front surface or a rear surface of the first object 201 exemplarily illustrated in FIGS. 2-4 and FIGS. 7-18. The first material of the first object 201 can be, for example, metal, wood, ceramic, stone, etc. Also, as used herein, "second object" refers to any tangible article, item, or external member made of a second material, that can be attached to the surface 201*a*, for example, the front surface or the rear surface of the first object 201, for example, a tile made of a first material dissimilar to the second material of the second object using the molded attachment block 1601. The second material of the second object can be, for example, metal, wood, ceramic stone, etc., that is dissimilar to the first material of the first object 201.

The method disclosed herein is a mechanical method for attaching one or more second objects made of a material dissimilar to a material of the first object 201, to the first object 201, for example, a tile without using any bonding material. The method disclosed herein comprises attaching second objects, for example, metal, plastic parts such as brackets, hinges, etc., threaded members, wire deflector plates, etc., to a first object 201, using a molded attachment block 1601 without marring the surface 201*a* of the first object 201 and the second objects in the process of assembly. For example, two or more first objects 201 can be attached together to construct a box. The method disclosed herein uses mechanical power and hand tools, for example, a tensioning device 226 and a pair of clamping devices 229 and 230 exemplarily illustrated in FIG. 2, for facilitating attachment of second objects made of second materials dissimilar to a first material of a first object 201 to the surface 201*a* of the first object 201 without marring the surface 201*a* of the first object 201. The method disclosed herein does not require use of glues or mortar for attaching second objects made of dissimilar materials to the surface 201*a* of the first object 201.

Figure 2:
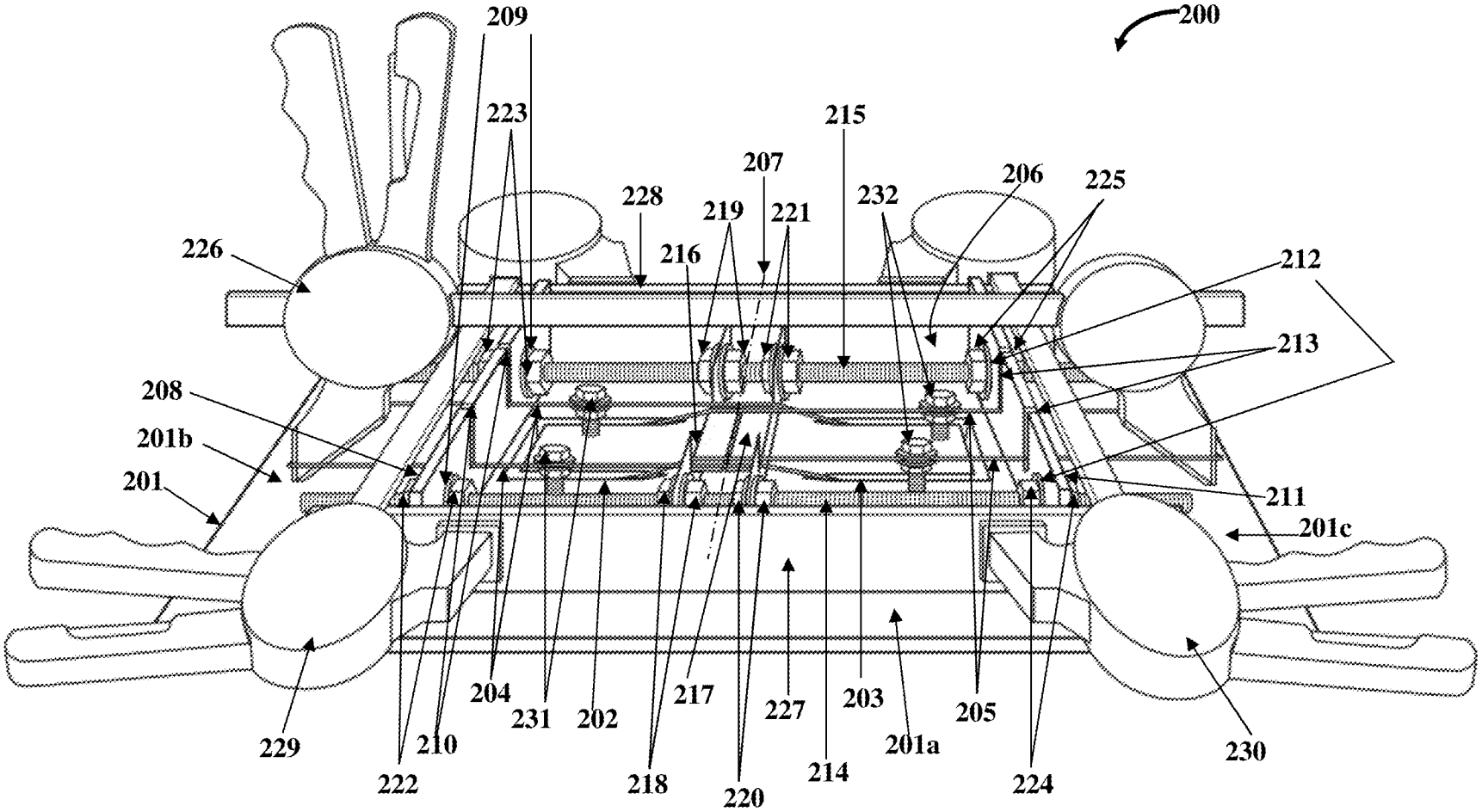
FIG. 2 exemplarily illustrates a top perspective view of an assembly for creating a molded attachment block on a surface of a first object made of a first material for attaching to one or more second objects made of one or more second materials.

The method disclosed herein comprises creating a molded attachment block 1601 from an assembly 200 comprising anchoring grooves 202 and 203 created on the surface 201*a* of the first object 201, tension bearing members 204 and 205, a constrained assembly 206, mold side members 227 and 228, and bolt assemblies 231 and 232 exemplarily illustrated in FIG. 2, for attaching one or more second objects made of one or more second materials dissimilar to a first material of the first object 201, to the surface 201*a* of the first object 201. As used herein, "anchoring grooves" refer to structures on the surface 201*a* of the first object 201 used to anchor and secure the tension bearing members 204 and 205, for example, metal wires or any wire that can sustain tension. In an embodiment, the tension bearing members 204 and 205 are wires made of metal, for example, aluminum, iron, steel, copper, etc., that can be extended to opposing sections 201*b* and 201*c* of the first object 201 from the anchoring grooves 203 and 202 respectively. The tension bearing members 204 and 205 are made of wires that sustain tension and resist an abrasive surface of a material of the first object 201 that the tension bearing members 204 and 205 contact. The strength of the tension bearing members 204 and 205 depends on loads of the first object 201 that are applied to the tension bearing members 204 and 205. For example, the tension bearing members 204 and 205 in the molded attachment block 1601 created from the assembly 200 used in an architectural planter can hold about 120 pounds of tension which is sufficient to hold the architectural planter together. Also, as used herein, "constrained assembly" refers to an assembly that is constrained by the tension bearing members 204 and 205 on the surface 201*a* of the first object 201. The constrained assembly 206 defines a location and structure of the molded block attachment 1601 on the surface 201*a* of the first object 201. The mold side members 227 and 228 define the sides of the assembly 200. The mold side members 227 and 228 are made of, for example, a plastic or coated metal.

In the method disclosed herein, the assembly 200 exemplarily illustrated in FIG. 2, for creating the molded attachment block 1601 exemplarily illustrated in FIGS. 16A-16B, is assembled as follows. Anchoring grooves 202 and 203 are created 101 at opposing sections 201*b* and 201*c* respectively, on the surface 201*a*, for example, the front surface or the rear surface of the first object 201 made of the first material. The tension bearing members 204 and 205 hook into the anchoring grooves 203 and 202 respectively. The anchoring grooves 202 and 203 anchor the tension bearing members 205 and 204 respectively, on the first object 201. A constrained assembly 206 is positioned 102 proximal to the created anchoring grooves 202 and 203 at the opposing sections 201*b* and 201*c* on the surface 201*a* of the first object 201 respectively. The constrained assembly 206 comprises at least two wire deflector plates 216 and 217, mold end members 208 and 211, and the threaded members 214 and 215, for example, threaded rods as exemplarily illustrated in FIG. 2. The threaded members 214 and 215 of the constrained assembly 206 are positioned perpendicular to the anchoring grooves 202 and 203. The two wire deflector plates 216 and 217 and then the mold end members 208 and 211 are positioned on the threaded members 214 and 215.

The mold end members 208 and 211 comprise openings 209 and 212 and slits 210 and 213 respectively. The openings 209 of the mold end member 208 receive and perpendicularly engage ends 214*a* and 215*a* of the threaded members 214 and 215 exemplarily illustrated in FIG. 5, respectively. The openings 212 of the mold end member 211 receive and perpendicularly engage ends 214*b* and 215*b* of the threaded members 214 and 215 respectively. The slits 210 and 213 of the mold end members 208 and 211 respectively, receive the tension bearing members 204 and 205 extending from the anchoring grooves 203 and 202 respectively, in opposing directions. The mold end members 208 and 211 are made of, for example, a plastic or coated metal. The wire deflector plates 216 and 217 are positioned parallel to the mold end members 208 and 211 and are connected to the threaded members 214 and 215 symmetrically about a central line 207, that is, an imaginary line, between the mold end members 208 and 211 using at least four deflector connectors 218, 219, 220, and 221 as exemplarily illustrated in FIG. 4. In an embodiment as exemplarily illustrated in FIG. 18, the constrained assembly 206 comprises at least two wire deflector threaded members 233 and 234, for example, two wire deflector threaded rods that perform the function of the wire deflector plates 216 and 217 as disclosed in the detailed description of FIG. 18.

After positioning the constrained assembly 206 proximal to the created anchoring grooves 202 and 203 at the opposing sections 201*b* and 201*c* on the surface 201*a* of the first object 201 respectively, the tension bearing members 204 and 205 are extended 103 from the created anchoring grooves 203 and 202 respectively, in opposing directions along a length of the constrained assembly 206 via the mold end members 208 and 211 respectively, that is, over the wire deflector plates 217 and 216 and through the slits 210 and 213 of the mold end members 208 and 211 respectively as exemplarily illustrated in FIG. 2 and FIGS. 7-15. Using a tensioning device 226, for example, a trigger clamp converted to a tensioning spreader as exemplarily illustrated in FIG. 2, a tension is generated 104 in the extended tension bearing members 204 and 205 as disclosed in the detailed description of FIG. 12. The tensioning device 226 pulls the tension bearing members 204 and 205 outwardly to generate a tension in the tension bearing members 204 and 205. The tensioning device 226 simultaneously tensions both the tension bearing members 204 and 205. With the tensioning device 226 straining the tension bearing members 204 and 205, the mold side members 227 and 228 are positioned 105 perpendicular to the mold end members 208 and 211 of the constrained assembly 206 as exemplarily illustrated in FIG. 2 and FIGS. 13-15. The mold side members 227 and 228 are positioned along the length of the constrained assembly 206 on the surface 201*a* of the first object 201. The constrained assembly 206 is then constricted 106 between the mold side members 227 and 228 using clamping devices 229 and 230 that are removably positioned on the mold side members 227 and 228 as exemplarily illustrated in FIG. 2 and FIGS. 14-15.

Figure 14:
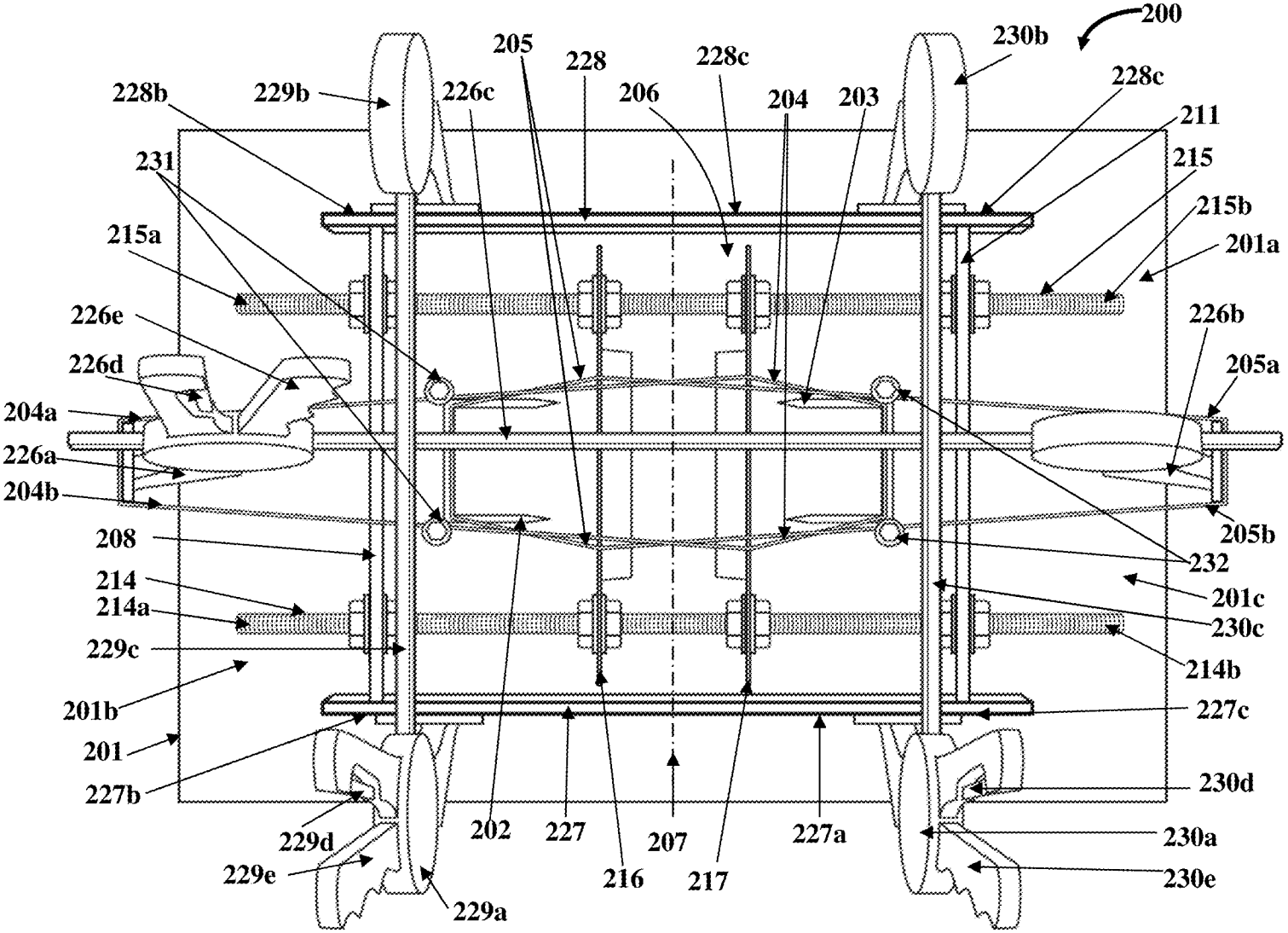
FIG. 14 exemplarily illustrates a top plan view of an embodiment of the assembly shown in FIG. 2.

The extended tension bearing members 204 and 205 under the generated tension are clamped 107 between at least four bolt assemblies 231 and 232 respectively, exemplarily illustrated in FIG. 2 and FIGS. 14-15, at any point within the constrained assembly 206 after the extended tension bearing members 204 and 205 are deflected by the wire deflector plates 217 and 216 respectively. The bolt assemblies 231 and 232 are positioned above the surface 201*a* of the first object 201 between the mold end members 208 and 211 of the constrained assembly 206. The bolt assemblies 231 and 232 are positioned within the constrained assembly 206 for gripping the extended tension bearing members 204 and 205, prior to inserting the ends 204*a*, 204*b* and 205*a*, 205*b* of the extended tension bearing members 204 and 205 respectively, through the slits 210 and 213 of the mold end members 208 and 211 respectively. A viscous liquid 1501 is poured as exemplarily illustrated in FIG. 15, and cured 108 on the constrained assembly 206, the extended tension bearing members 204 and 205, the anchoring grooves 202 and 203, and the bolt assemblies 231 and 232 for creating the molded attachment block 1601 with the opposing ends 214*a*, 214*b* and 215*a*, 215*b* of the threaded members 214 and 215 of the constrained assembly 206 respectively, extending outwardly from the molded attachment block 1601 as exemplarily illustrated in FIG. 16A. The viscous liquid 1501 is poured on the constrained assembly 206, the extended tension bearing members 204 and 205, the anchoring grooves 202 and 203, and the bolt assemblies 231 and 232 and allowed to cure while tension is maintained in the extended tension bearing members 204 and 205 by the tensioning device 226.

The ends 204*a*, 204*b* and 205*a*, 205*b* of the extended tension bearing members 204 and 205 respectively, that extend outwardly from the created molded attachment block 1601 in opposing directions, after curing of the viscous liquid 1501, are then cut as exemplarily illustrated in FIG. 16B. The constrained assembly 206 with the mold end members 208 and 211, the extended tension bearing members 204 and 205, the anchoring grooves 202 and 203, the mold side members 227 and 228, and the bolt assemblies 231 and 232 remain within the molded attachment block 1601. In an embodiment, after curing of the viscous liquid 1501, the mold side members 227 and 228 and the mold end members 208 and 211 are removed from the molded attachment block 1601 and the tension bearing members 204 and 205 that extend beyond the molded attachment block 1601 are cut. In this embodiment, the extended tension bearing members 204 and 205, the anchoring grooves 202 and 203, the bolt assemblies 231 and 232, and the constrained assembly 206 without the mold end members 208 and 211 remain within the molded attachment block 1601. In an embodiment, the mold side members 227 and 228 are removed from the molded attachment block 1601 and the constrained assembly 206 with the mold end members 208 and 211 are retained in the molded attachment block 1601 along with the extended tension bearing members 204 and 205, the anchoring grooves 202 and 203, and the bolt assemblies 231 and 232. The extended opposing ends 214*a*, 214*b* and 215*a*, 215*b* of the threaded members 214 and 215 respectively, allow attachment of other second objects, for example, brackets, hinges, etc., made of the second materials dissimilar to the first material of the first object 201, to the surface 201*a* of the first object 201 without any bonding material. In an embodiment, the mold end members 208 and 211, the threaded members 214 and 215, the wire deflector plates 216 and 217, and the mold side members 227 and 228 are the second objects made of the second material that are attached to the first object 201 made of the first material. In the method disclosed herein, the tension in the tension bearing members 204 and 205 is preserved to produce a force that presses the molded attachment block 1601 against the surface 201*a* of the first object 201, thereby allowing, for example, steel mechanical elements to be attached to non-metallic or other dissimilar materials.

In the method disclosed herein, the threaded members 214 and 215 are extended beyond the mold end members 208 and 211 of the molded attachment block 1601 for leveraging mechanical properties of the threaded members 214 and 215 for attaching other second objects, for example, hinges, brackets, etc., and other first objects to the first object 201. In an embodiment, the threaded members 214 and 215 are used to attach the mold end members 208 and 211 to the molded attachment block 1601 so that the mold end members 208 and 211 remain within the molded attachment block 1601 after the viscous liquid 1501 is cured. In this embodiment, the threaded members 214 and 215, the mold end members 208 and 211, and the wire deflector plates 216 and 217 can be the second objects made of the second material that attach to the surface 201*a* of the first object 201 made of the first material. In an embodiment, the mold end members 208 and 211 retained within the molded attachment block 1601 after curing of the viscous liquid 1501, are extended beyond the molded attachment block 1601 for leveraging mechanical properties of the second material of the mold end members 208 and 211 to attach other second objects, for example, hinges, brackets, etc., to the first object 201. In another embodiment, the wire deflector plates 216 and 217 are extended, for example, from sides of the molded attachment block 1601 for leveraging mechanical properties of the second material of the wire deflector plates 216 and 217 to attach other second objects, for example, hinges, brackets, etc., to the first object 201. In another embodiment, the threaded members 214 and 215 span multiple molded attachment blocks 1601 that are located on multiple different first objects for mechanically joining the first objects.

The method disclosed herein can be used for constructing any form of an assembly, for example, architectural planters of multiple shapes, retaining walls or similar structures, wall cladding structures, furniture items such as chests, bookcases, benches, tables, kitchen cabinets, etc. In an embodiment, retaining walls (not shown) constructed by attaching a first object 201 to another first object (not shown), using multiple molded attachment blocks 1601 created on the first objects, by the method disclosed herein can withstand weather seismic occurrences better than conventional masonry structures. These retaining walls can withstand weather seismic occurrences due to the inherent flexibility of the tension bearing members 204 and 205 of the molded attachment blocks 1601 used in the retaining walls. In an embodiment, in the construction of wall cladding structures (not shown), a first object 201 can be directly bolted to wall studs using the molded attachment block 1601 disclosed herein rather than attaching the first object 201 to an interior wall using bonding materials such as glue, adhesives, etc.

Assembling a first object 201 allows modular construction and allows the first object 201 and the second objects to be attached mechanically using the molded attachment block 1601. One or more objects comprising the first object 201 and the second objects can be attached together to build a large and complex structure. For example, a person can avoid hiring a mason to construct an architectural planter and instead can buy a kit comprising multiple first objects 201 with the molded attachment blocks 1601 disclosed herein, that can be attached together using second objects to construct the architectural planter structure with minimal skill.

FIG. 2 exemplarily illustrates a top perspective view of an assembly 200 for creating a molded attachment block 1601 exemplarily illustrated in FIGS. 16A-16B, on a surface 201*a* of a first object 201 made of a first material for attaching to one or more second objects made of one or more second materials. The assembly 200 comprising the anchoring grooves 202 and 203 created at opposing sections 201*b* and 201*c* on the surface 201*a* of the first object 201 respectively, the constrained assembly 206, the extended tension bearing members 204 and 205, the mold side members 227 and 228, and the bolt assemblies 231 and 232 is positioned on the surface 201*a* of the first object 201 as exemplarily illustrated in FIG. 2. The molded attachment block 1601 is created on curing of the viscous liquid 1501 poured on the assembly 200 as exemplarily illustrated in FIG. 15. The molded attachment block 1601 is used to attach second objects made of one or more second materials, for example, steel, to the first object 201, for example, a tile made of a first material such as a ceramic material.

The constrained assembly 206 comprises a pair of mold end members 208 and 211 that define limits of the molded attachment block 1601, a pair of threaded members 214 and 215, for example, threaded rods, and a pair of wire deflector plates 216 and 217 that are connected to the threaded members 214 and 215 using at least four deflector connectors 218, 219, 220, and 221. The mold end members 208 and 211 comprise slits 210 and 213 and openings 209 and 212 respectively, as disclosed in the detailed description of FIG. 1. The tension bearing members 204 and 205 are anchored in the anchoring grooves 203 and 202 respectively and extended via the slits 210 and 213 in the mold end members 208 and 211 respectively, in opposing directions as exemplarily illustrated in FIGS. 7-15. The threaded members 214 and 215 engage with the mold end members 208 and 211 at the openings 209 and 212 of the mold end members 208 and 211 respectively, via mold end connectors 222, 223, 224, and 225 as disclosed in the detailed description of FIG. 5. The tensioning device 226 pulls the tension bearing members 204 and 205 that extend in opposing directions to generate the tension in the extended tension bearing members 204 and 205. The mold side members 227 and 228 are positioned perpendicular to the mold end members 208 and 211. The mold side members 227 and 228 are positioned on opposing sides of the constrained assembly 206 along the length of the constrained assembly 206 to constrict the constrained assembly 206 using the clamping devices 229 and 230. The four bolt assemblies 231 and 232 comprising bolt members 231*a* and 232*a*, nuts 231*d* and 232*d*, and washers 231*b*, 231*c* and 232*b*, 232*c* respectively exemplarily illustrated in FIG. 15, grip the extended tension bearing members 204 and 205 to hold the generated tension in the extended tension bearing members 204 and 205 after the viscous liquid 1501 poured on the assembly 200 cures and hardens. The bolt assemblies 231 and 232 preclude the extended tension bearing members 204 and 205 from moving within the viscous liquid 1501 after the viscous liquid 1501 hardens to form the molded attachment block 1601 exemplarily illustrated in FIGS. 16A-16B.

The steps of the method disclosed in the detailed description of FIG. 1 above are exemplarily illustrated in FIGS. 3-15 and disclosed below for creation of the molded attachment block 1601 exemplarily illustrated in FIGS. 16A-16B.

Figure 3:
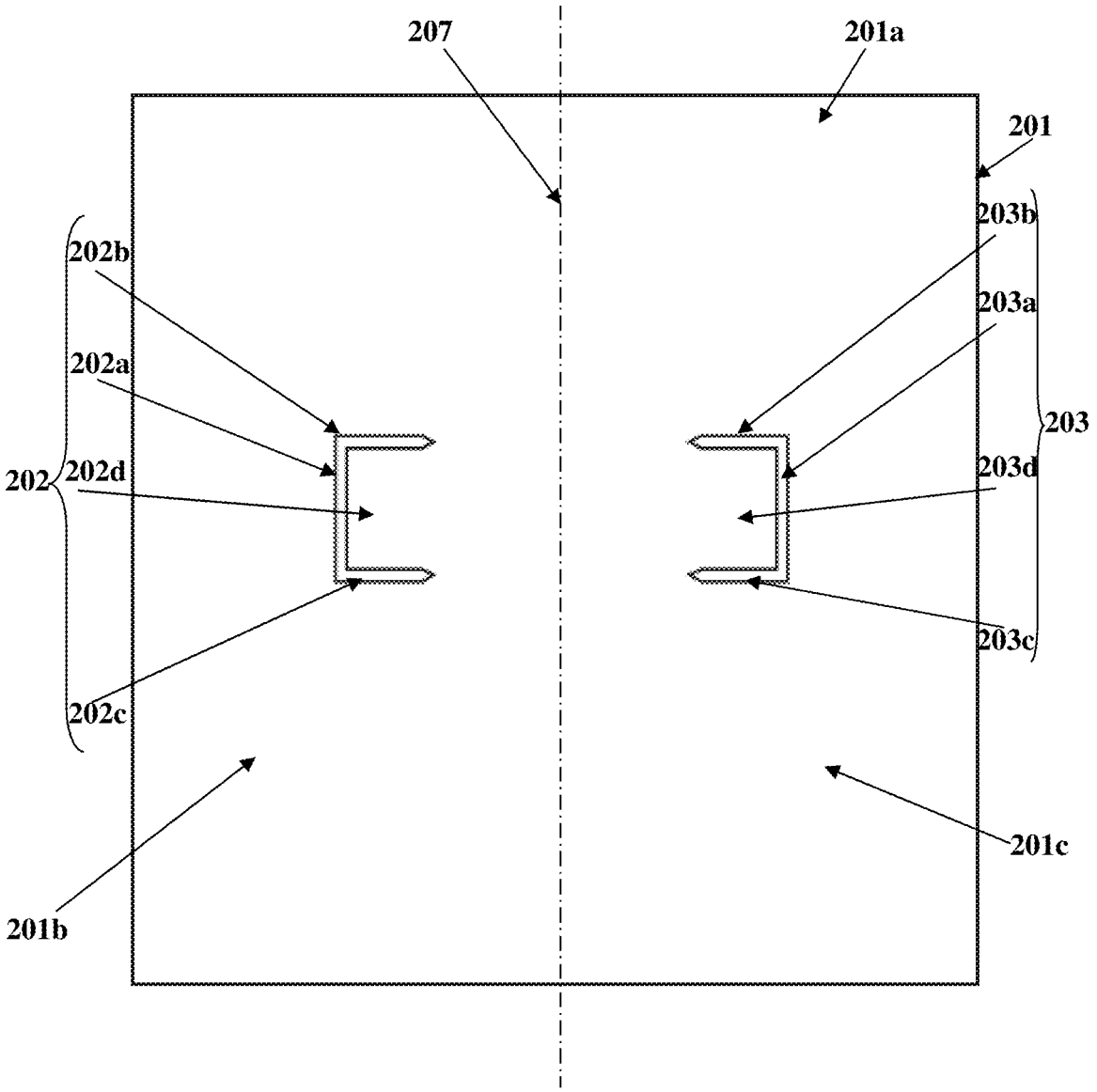
FIG. 3 exemplarily illustrates a top plan view of a first object made of a first material, showing anchoring grooves created at opposing sections on a surface of the first object.

FIG. 3 exemplarily illustrates a top plan view of a first object 201 made of a first material, showing the anchoring grooves 202 and 203 created at opposing sections 201*b* and 201*c* respectively, on the surface 201*a* of the first object 201. The locations of the anchoring grooves 202 and 203 on the surface 201*a* of the first object 201, for example, a tile, are selected based on the position of the molded attachment block 1601 exemplarily illustrated in FIGS. 16A-16B, to be created on the surface 201*a* of the first object 201. The anchoring grooves 202 and 203 are created at locations symmetrical about a central line 207, that is, an imaginary line, between the mold end members 208 and 211 of the constrained assembly 206. The anchoring grooves 202 and 203 are identical and symmetrical about the central line 207 between the mold end members 208 and 211 and are positioned to lie within the molded attachment block 1601 to be created. That is, the anchoring grooves 202 and 203 are mirror images of each other about the central line 207. The anchoring grooves 202 and 203 are cut into the surface 201*a* of the first object 201 such that the anchoring grooves 202 and 203 are centered and fit inside the molded attachment block 1601. The anchoring grooves 202 and 203 are confined to an area of the molded attachment block 1601. In an embodiment, each of the anchoring grooves 202 and 203 is U-shaped. That is, the anchoring grooves 202 and 203 comprise linear sections 202*a* and 203*a* respectively, and two perpendicular sections 202*b*, 202*c* and 203*b*, 203*c* that extend from the linear sections 202*a* and 203*a* respectively. The anchoring grooves 202 and 203 are created by cutting the surface 201*a* of the first object 201 using a cutter (not shown). The cutter is held perpendicular to the surface 201*a* of the first object 201 for cutting the perpendicular sections 202*b*, 202*c* and 203*b*, 203*c* of the anchoring grooves 202 and 203 respectively, into the surface 201*a* of the first object 201. The cutter is held at a vertical angle of, for example, less than 45 degrees with respect to the surface 201*a* of the first object 201 for cutting the linear sections 202*a* and 203*a* of the anchoring grooves 202 and 203 respectively, into the surface 201*a* of the first object 201, resulting in the creation of tabs 202*d* and 203*d* at the anchoring grooves 202 and 203 respectively. The linear sections 202*a* and 203*a* of the anchoring grooves 202 and 203 respectively, are cut parallel to the central line 207. The tabs 202*d* and 203*d* created by cutting the linear sections 202*a* and 203*a* of the anchoring grooves 202 and 203 respectively, are used for anchoring the tension bearing members 205 and 204 respectively, as exemplarily illustrated in FIGS. 7-15. The length of the tension bearing members 204 and 205 anchored in the anchoring grooves 203 and 202 respectively, is dependent on depths of the linear sections 203*a* and 202*a* of the anchoring grooves 203 and 202 respectively. For a first object 201, for example, a thin tile, the depth of the anchoring grooves 202 and 203 is, for example, an eighth of an inch, that is, 0.125".

Figure 4:
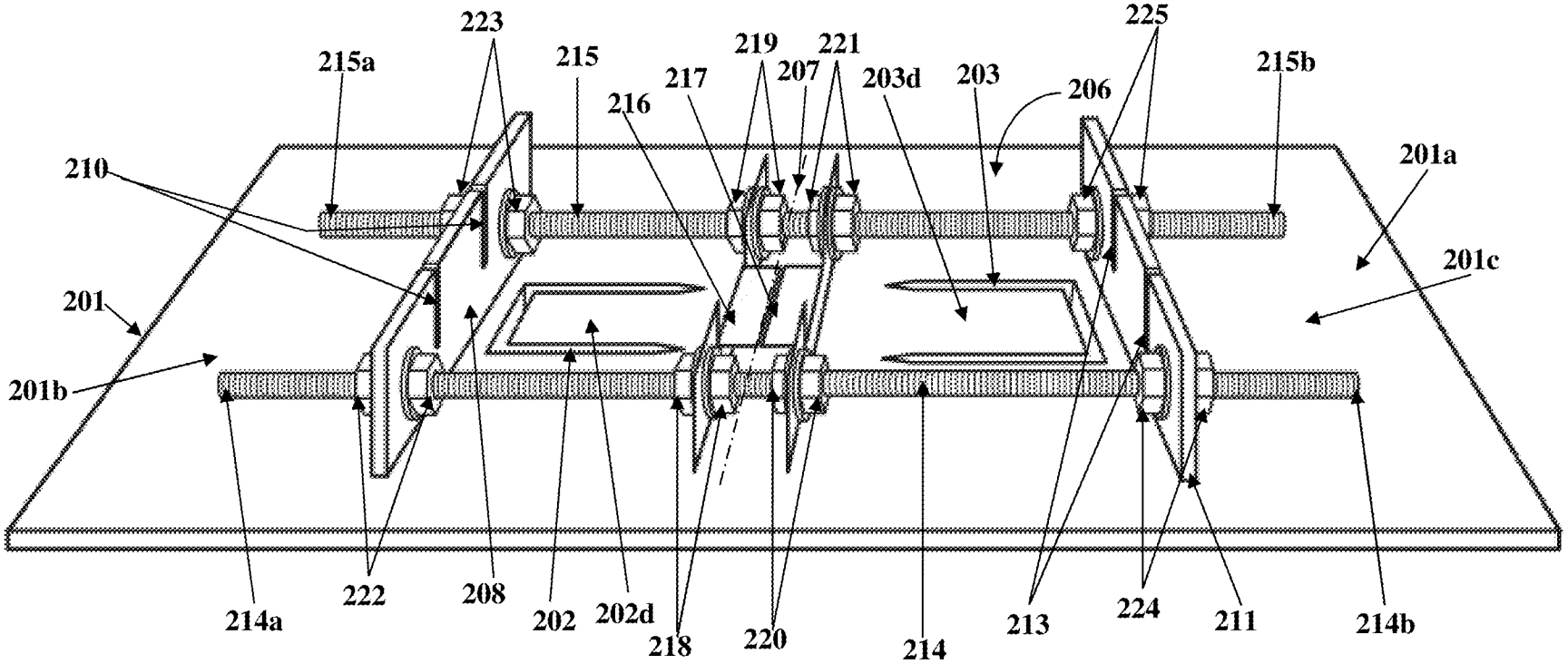
FIG. 4 exemplarily illustrates a top perspective view showing a constrained assembly positioned on the surface of the first object.

FIG. 4 exemplarily illustrates a top perspective view showing the constrained assembly 206 positioned on the surface 201*a* of the first object 201. The constrained assembly 206 comprising the mold end members 208 and 211, the threaded members 214 and 215, and the wire deflector plates 216 and 217 is positioned proximal to the anchoring grooves 202 and 203 created at the opposing sections 201*b* and 201*c* respectively, on the surface 201*a* of the first object 201 exemplarily illustrated in FIG. 3. The anchoring grooves 202 and 203 are contained between the mold end members 208 and 211 as exemplarily illustrated in FIG. 4. The distance between the mold end members 208 and 211 is greater than the distance between the anchoring grooves 202 and 203 created on the surface 201*a* of the first object 201. The mold end members 208 and 211 are positioned parallel to the anchoring grooves 202 and 203. The mold end members 208 and 211 are identical and symmetrical about the central line 207. The mold end members 208 and 211 comprise slits 210 and 213 for receiving the tension bearing members 204 and 205 respectively, and openings 209 and 212 for engaging the ends 214*a*, 215*a* and 214*b*, 215*b* of the threaded members 214 and 215, using at least four mold end connectors 222, 223, 224, and 225 as exemplarily illustrated in FIG. 4.

The threaded members 214 and 215 of the constrained assembly 206 are positioned and connected perpendicular to the mold end members 208 and 211. The threaded members 214 and 215 are positioned parallel to each other. The threaded members 214 and 215 are structural members, for example, reinforcement bars, rectangular tubes, round tubes, round bars, rectangular bars, channels, angles, etc., made of, for example, steel. The openings 209 and 212 in the mold end members 208 and 211 are located such that the threaded members 214 and 215, when engaged with the mold end members 208 and 211, are equidistant from the anchoring grooves 202 and 203. That is, the anchoring grooves 202 and 203 are positioned at locations equidistant from both the threaded members 214 and 215 of the constrained assembly 206. The wire deflector plates 216 and 217 of the constrained assembly 206 are connected to the threaded members 214 and 215 equidistant from the central line 207 between the mold end members 208 and 211. The wire deflector plates 216 and 217 are connected to the threaded members 214 and 215 using the deflector connectors 218, 219, 220, and 221 as exemplarily illustrated in FIG. 4. The distance between the wire deflector plates 216 and 217 is selected based on the size of the molded attachment block 1601 exemplarily illustrated in FIGS. 16A-16B, to be created. As exemplarily illustrated in FIG. 4, the wire deflector plates 216 and 217 are positioned close to each other to create a small molded attachment block 1601.

Figure 5:
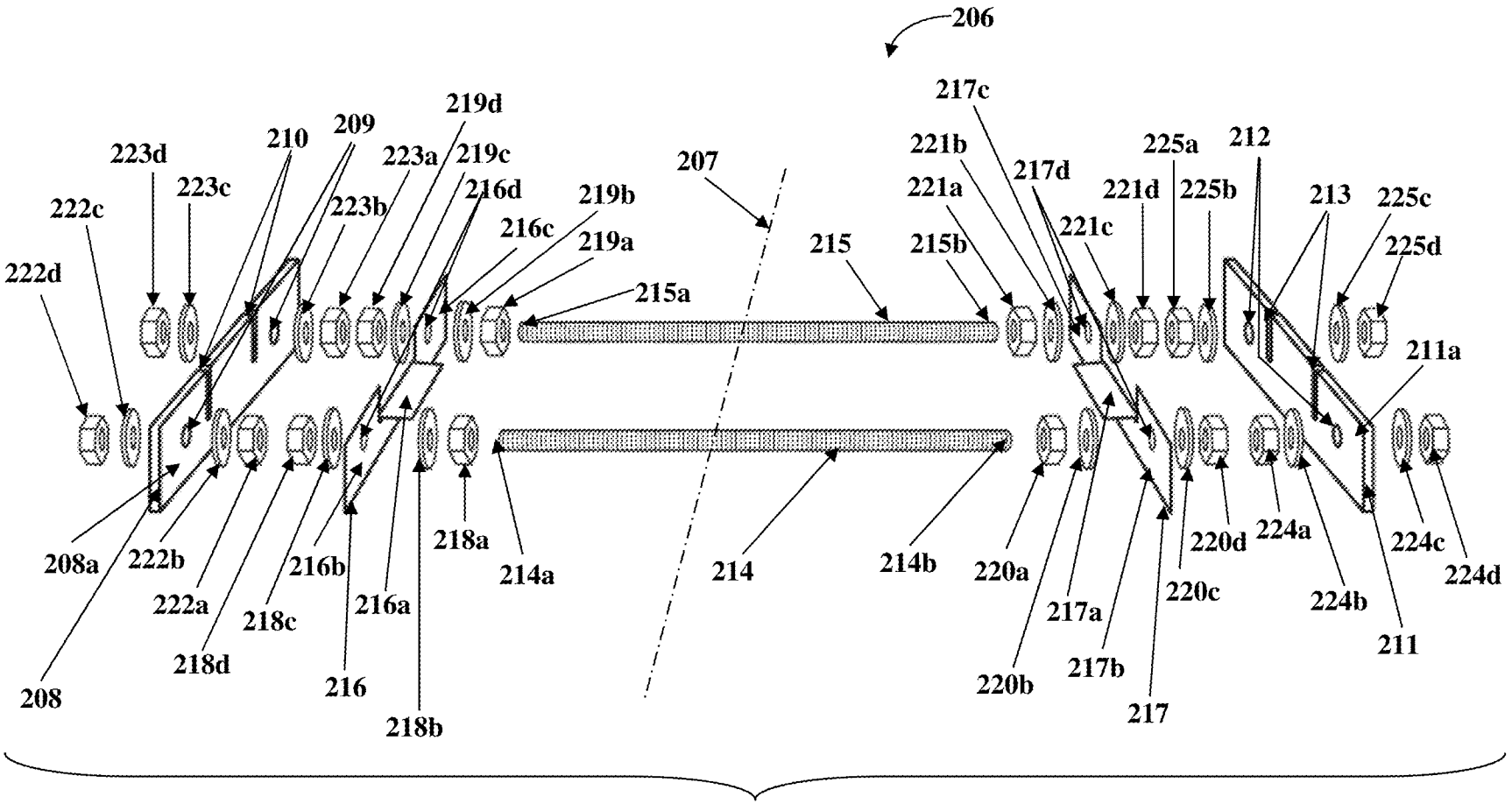
FIG. 5 exemplarily illustrates an exploded view of the constrained assembly used for creating the molded attachment block.

FIG. 5 exemplarily illustrates an exploded view of the constrained assembly 206 used for creating the molded attachment block 1601 exemplarily illustrated in FIGS. 16A-16B. As exemplarily illustrated in FIG. 5, the constrained assembly 206 comprises a pair of threaded members 214 and 215, a pair of wire deflector plates 216 and 217, a pair of mold end members 208 and 211, the deflector connectors 218, 219, 220, and 221 exemplarily illustrated in FIG. 4, and the mold end connectors 222, 223, 224, and 225 exemplarily illustrated in FIG. 4. The mold end member 208 comprises a pair of openings 209 for receiving the threaded members 214 and 215 via the ends 214*a* and 215*a* of the threaded members 214 and 215 respectively, and a pair of slits 210 for receiving the tension bearing member 204 from the anchoring groove 203 as exemplarily illustrated in FIG. 7. The mold end member 211 comprises a pair of openings 212 for receiving the threaded members 214 and 215 via the ends 214*b* and 215*b* of the threaded members 214 and 215 respectively, and a pair of slits 213 for receiving the other tension bearing member 205 extending from the anchoring groove 202 as exemplarily illustrated in FIG. 10. The openings 209 and 212 and the slits 210 and 213 in the mold end members 208 and 211 respectively, are symmetrical about centers of the mold end members 208 and 211. The wire deflector plates 216 and 217 of the constrained assembly 206 are centrally connected to the threaded members 214 and 215 using the deflector connectors 218, 219, 220, and 221. The deflector connectors 218 and 219 comprising nuts 218*a*, 218*d*, and 219*a*, 219*d* respectively, and washers 218*b*, 218*c*, and 219*b*, 219*c* respectively, connect the wire deflector plate 216 to the threaded members 214 and 215 respectively. That is, the wire deflector plate 216 is connected to the threaded member 214 using the nuts 218*a* and 218*d* and the washers 218*b* and 218*c* on both sides of the wire deflector plate 216 as exemplarily illustrated in FIG. 5. Moreover, the wire deflector plate 216 is connected to the threaded member 215 using the nuts 219*a* and 219*d* and the washers 219*b* and 219*c* on both sides of the wire deflector plate 216 as exemplarily illustrated in FIG. 5. Similarly, the deflector connectors 220 and 221 comprising nuts 220*a*, 220*d*, and 221*a*, 221*d* respectively, and washers 220*b*, 220*c*, and 221*b*, 221*c* respectively, connect the wire deflector plate 217 to the threaded members 214 and 215 respectively. That is, the wire deflector plate 217 is connected to the threaded member 214 using the nuts 220*a* and 220*d* and the washers 220*b* and 220*c* on both sides of the wire deflector plate 217 as exemplarily illustrated in FIG. 5. Moreover, the wire deflector plate 217 is connected to the threaded member 215 using the nuts 221*a* and 221*d* and the washers 221*b* and 221*c* on both sides of the wire deflector plate 217 as exemplarily illustrated in FIG. 5.

Each of the wire deflector plates 216 and 217 comprises a plate section 216*a* and 217*a* and a pair of wing sections 216*b*, 216*c* and 217*b*, 217*c* extending from the respective plate sections 216*a* and 217*a*. The wing sections 216*b*, 216*c* and 217*b*, 217*c* of the wire deflector plates 216 and 217 respectively, comprise openings 216*d* and 217*d* to receive the threaded members 214 and 215 respectively, and the corresponding deflector connectors 218, 219, 220, and 221. The threaded members 214 and 215 engage with the mold end members 208 and 211 via the openings 209 and 212 of the mold end members 208 and 211 respectively, using the mold end connectors 222, 223, 224, and 225. The mold end connectors 222 and 223 comprising nuts 222*a*, 222*d*, and 223*a*, 223*d* respectively, and washers 222*b*, 222*c*, and 223*b*, 223*c* respectively, connect the mold end member 208 to the threaded members 214 and 215 respectively. That is, the mold end member 208 is connected to the threaded member 214 using the nuts 222*a* and 222*d* and the washers 223*b* and 223*c* on both sides of the mold end member 208 as exemplarily illustrated in FIG. 5. Moreover, the mold end member 208 is connected to the threaded member 215 using the nuts 223*a* and 223*d* and the washers 223*b* and 223*c* on both sides of the mold end member 208 as exemplarily illustrated in FIG. 5. Similarly, the mold end connectors 224 and 225 comprising nuts 224*a*, 224*d*, and 225*a*, 225*d* respectively, and washers 224*b*, 224*c*, and 225*b*, 225*c* respectively, connect the mold end member 211 to the threaded members 214 and 215 respectively. That is, the mold end member 211 is connected to the threaded member 214 using the nuts 224*a* and 224*d* and the washers 224*b* and 224*c* on both sides of the mold end member 211 as exemplarily illustrated in FIG. 5. Moreover, the mold end member 211 is connected to the threaded member 215 using the nuts 225*a* and 225*d* and the washers 225*b* and 225*c* on both sides of the mold end member 211 as exemplarily illustrated in FIG. 5.

The constrained assembly 206 is assembled as follows: The location of connection of the mold end members 208 and 211 to the threaded members 214 and 215 is determined. The wire deflector plates 216 and 217 with their respective wing sections 216*b*, 216*c* and 217*b*, 217*c* are aligned parallel to the mold end members 208 and 211 and are positioned symmetrically about the central line 207 between the mold end members 208 and 211. The nuts 218*a*, 219*a*, 220*a*, and 221*a* and the washers 218*b*, 219*b*, 220*b*, and 221*b* are engaged with the threaded members 214 and 215 prior to positioning the wire deflector plates 216 and 217 on the threaded members 214 and 215. The wire deflector plates 216 and 217 are then positioned on the threaded members 214 and 215 through their respective openings 216*d* and 217*d*. The washers 218*c*, 219*c*, 220*c*, and 221*c* and the nuts 218*d*, 219*d*, 220*d*, and 221*d* are then positioned to succeed the wire deflector plates 216 and 217 on the threaded members 214 and 215 as exemplarily illustrated in FIG. 4. The mold end member 208 is positioned proximal to the ends 214*a* and 215*a* of the threaded members 214 and 215 respectively, via the openings 209 of the mold end member 208 at the predetermined location on the threaded members 214 and 215. Similarly, the mold end member 211 is positioned proximal to the ends 214*b* and 215*b* of the threaded members 214 and 215 respectively, via the openings 212 of the mold end member 211 at the predetermined location on the threaded members 214 and 215. The nuts 222*a*, 223*a*, 224*a*, and 225*a* and the washers 222*b*, 223*b*, 224*b*, and 225*b* are positioned to precede the mold end members 208 and 211 on the threaded members 214 and 215 as exemplarily illustrated in FIG. 4. The washers 222*c*, 223*c*, 224*c*, and 225*c* and the nuts 222*d*, 223*d*, 224*d*, and 225*d* are positioned to succeed the mold end members 208 and 211 on the threaded members 214 and 215 as exemplarily illustrated in FIG. 4. The threaded members 214 and 215 are inserted through the openings 209 and 212 in the mold end members 208 and 211 respectively, and the mold end members 208 and 211 are positioned at predetermined locations about the central line 207 on the threaded members 214 and 215 such that the distance between the mold end members 208 and 211 is greater than the distance between the anchoring grooves 202 and 203.

In an embodiment, the nuts 218*a* and 218*d*, 219*a* and 219*d*, 220*a* and 220*d*, and 221*a* and 221*d*, and the washers 218*b* and 218*c*, 219*b* and 219*c*, 220*b* and 220*c*, and 221*b* and 221*c* of the deflector connectors 218, 219, 220, and 221 respectively, and the nuts 222*a*, 223*a*, 224*a*, and 225*a* and the washers 222*b*, 223*b*, 224*b*, and 225*b* of the mold end connectors 222, 223, 224, and 225 respectively, are absent and only the nuts 222*d*, 223*d*, 224*d*, and 225*d* and the washers 222*c*, 223*c*, 224*c*, and 225*c* of the mold end connectors 222, 223, 224, and 225 respectively, are positioned and engaged on the threaded members 214 and 215. In this embodiment, the nuts 222*d*, 223*d*, 224*d* and 225*d* and the washers 222*c*, 223*c*, 224*c*, and 225*c* of the mold end connectors 222, 223, 224, and 225 respectively, are retained to maintain the position of the mold end members 208 and 211 when the viscous liquid 1501 is poured on the constrained assembly 206, the anchoring grooves 202 and 203, and the tension bearing members 204 and 205 as exemplarily illustrated in FIG. 15, for creation of the molded attachment block 1601. In an embodiment, the wire deflector plates 216 and 217 are connected to the threaded members 214 and 215 by welding. In another embodiment, the wire deflector plates 216 and 217 are connected to the threaded members 214 and 215 by soldering. In another embodiment, the wire deflector plates 216 and 217 are connected to the threaded members 214 and 215 by using a bonding material, for example, an adhesive such as glue. The tension bearing members 204 and 205, when under tension, push down on the wire deflector plates 216 and 217, thereby holding the wire deflector plates 216 and 217 in position. The wire deflector plates 216 and 217 positioned on the threaded members 214 and 215 using the deflector connectors 218, 219, 220, and 221 support and deflect the tension bearing members 204 and 205. The thinness of the wire deflector plates 216 and 217 prevent the wire deflector plates 216 and 217 from moving along longitudinal axes of the threaded members 214 and 215.

The mold end members 208 and 211 are made of a metallic material. For the first object 201, for example, a tile, made of a ceramic material, the mold end members 208 and 211 made of the metallic material are positioned on the threaded members 214 and 215. The mold end members 208 and 211 made of the metallic material ensure the viscous liquid 1501 poured on the constrained assembly 206, the anchoring grooves 202 and 203, and the tension bearing members 204 and 205 as exemplarily illustrated in FIG. 15, does not melt the mold end members 208 and 211 since the mold end members 208 and 211 are removed from the molded attachment block 1601, after curing of the viscous liquid 1501. In an embodiment where the viscous liquid 1501 to be poured into the assembly 200 exemplarily illustrated in FIG. 2, is concrete or soap, a non-stick coating is applied on inner surfaces 208*a* and 211*a* of the mold end members 208 and 211 respectively, for easy removal of the mold end members 208 and 211 from the molded attachment block 1601 on curing of the viscous liquid 1501. In an embodiment, the tension bearing members 204 and 205 are under a substantially high tension. To hold the tension bearing members 204 and 205 under the substantially high tension, the mold end members 208 and 211 are configured to be L-shaped (not shown). Each of the L-shaped mold end members comprises a horizontal plate section (not shown) positioned in contact with the surface 201*a* of the first object 201 and a vertical plate section (not shown) that functions as a mold end member 208 or 211. The horizontal plate sections of the L-shaped mold end members distribute a resulting force of substantially high tensions in the tension bearing members 204 and 205 over a large area of the first object 201.

Figure 6A:
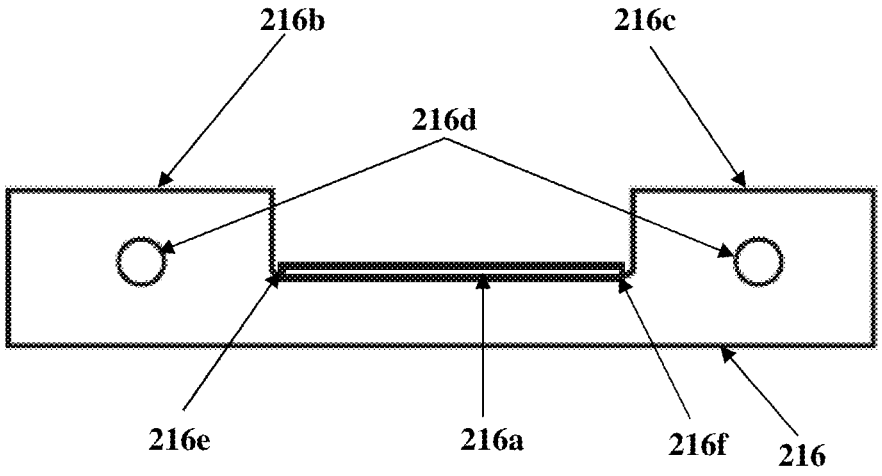
FIG. 6A exemplarily illustrates a front elevation view of a wire deflector plate of the constrained assembly.

FIG. 6A exemplarily illustrates a front elevation view of a wire deflector plate 216 of the constrained assembly 206 exemplarily illustrated in FIG. 4. The wire deflector plate 216 comprises a plate section 216*a* and a pair of wing sections 216*b* and 216*c* extending from opposing sides 216*e* and 216*f* of the plate section 216*a* respectively. The plate section 216*a* receives the tension bearing members 204 and 205 under tension and supports and deflects the tension bearing members 204 and 205 under tension. The wing sections 216*b* and 216*c* of the wire deflector plate 216 are connected to the threaded members 214 and 215 via the openings 216*d* of the wire deflector plate 216 as exemplarily illustrated in FIGS. 4-5, using the deflector connectors 218 and 219 as exemplarily illustrated in FIG. 4. The wing sections 216*b* and 216*c* of the wire deflector plate 216 that are engaged with the threaded members 214 and 215 respectively, via the openings 216*d* of the wire deflector plate 216 as exemplarily illustrated in FIG. 4, hold the wire deflector plate 216 in place when the tension bearing members 204 and 205 are extended from the anchoring grooves 203 and 202 respectively, as exemplarily illustrated in FIG. 10. Thickness of the plate section 216*a* and the wing sections 216*b* and 216*c* of the wire deflector plate 216 is configured based on the tension borne in the tension bearing members 204 and 205. The structure and function of the other wire deflector plate 217 exemplarily illustrated in FIGS. 4-5, is similar to the structure and function of the wire deflector plate 216 disclosed herein. The wing sections 217*b* and 217*c* of the wire deflector plate 217 are connected to the threaded members 214 and 215 via the openings 217*d* of the wire deflector plate 217 as exemplarily illustrated in FIGS. 4-5, using the deflector connectors 220 and 221 as exemplarily illustrated in FIG. 4.

Figure 6B:
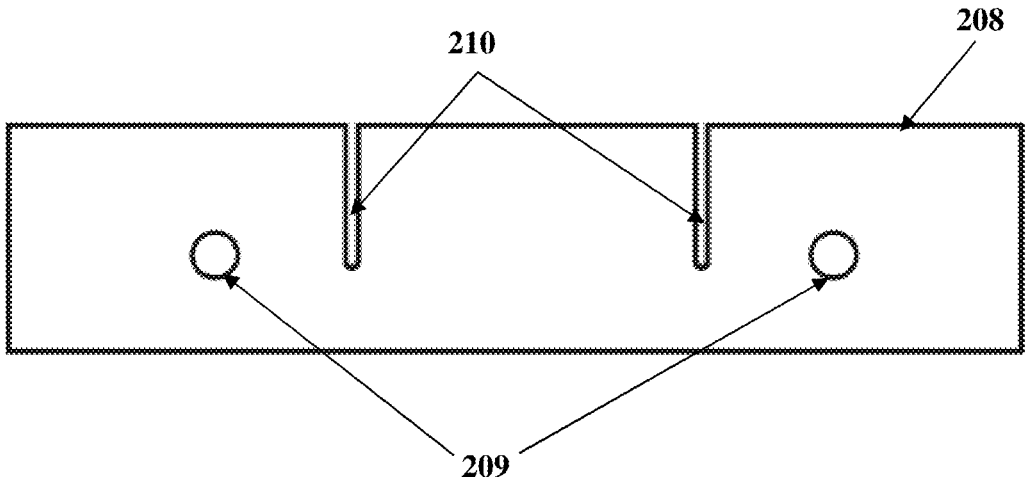
FIG. 6B exemplarily illustrates a front elevation view of a mold end member of the constrained assembly.

FIG. 6B exemplarily illustrates a front elevation view of a mold end member 208 of the constrained assembly 206 exemplarily illustrated in FIG. 4. The mold end member 208 comprises a pair of slits 210 for receiving the tension bearing member 204 and a pair of openings 209 for connecting the mold end member 208 to the threaded members 214 and 215 as exemplarily illustrated in FIG. 7. The mold end member 208 is inserted onto the threaded members 214 and 215 via the openings 209 of the mold end member 208 exemplarily illustrated in FIG. 5 and is connected to the threaded members 214 and 215 using the mold end connectors 222 and 223 as exemplarily illustrated in FIG. 4. The structure and function of the other mold end member 211 exemplarily illustrated in FIGS. 4-5, is similar to the structure and function of the mold end member 208 disclosed herein. The mold end member 211 is inserted onto the threaded members 214 and 215 via the openings 212 of the mold end member 211 exemplarily illustrated in FIG. 5 and is connected to the threaded members 214 and 215 using the mold end connectors 224 and 225 as exemplarily illustrated in FIG. 4. The mold end members 208 and 211 are positioned to contact the surface 201*a* of the first object 201 exemplarily illustrated in FIG. 4. The mold end members 208 and 211 are configured as legs of the constrained assembly 206.

Figure 7:
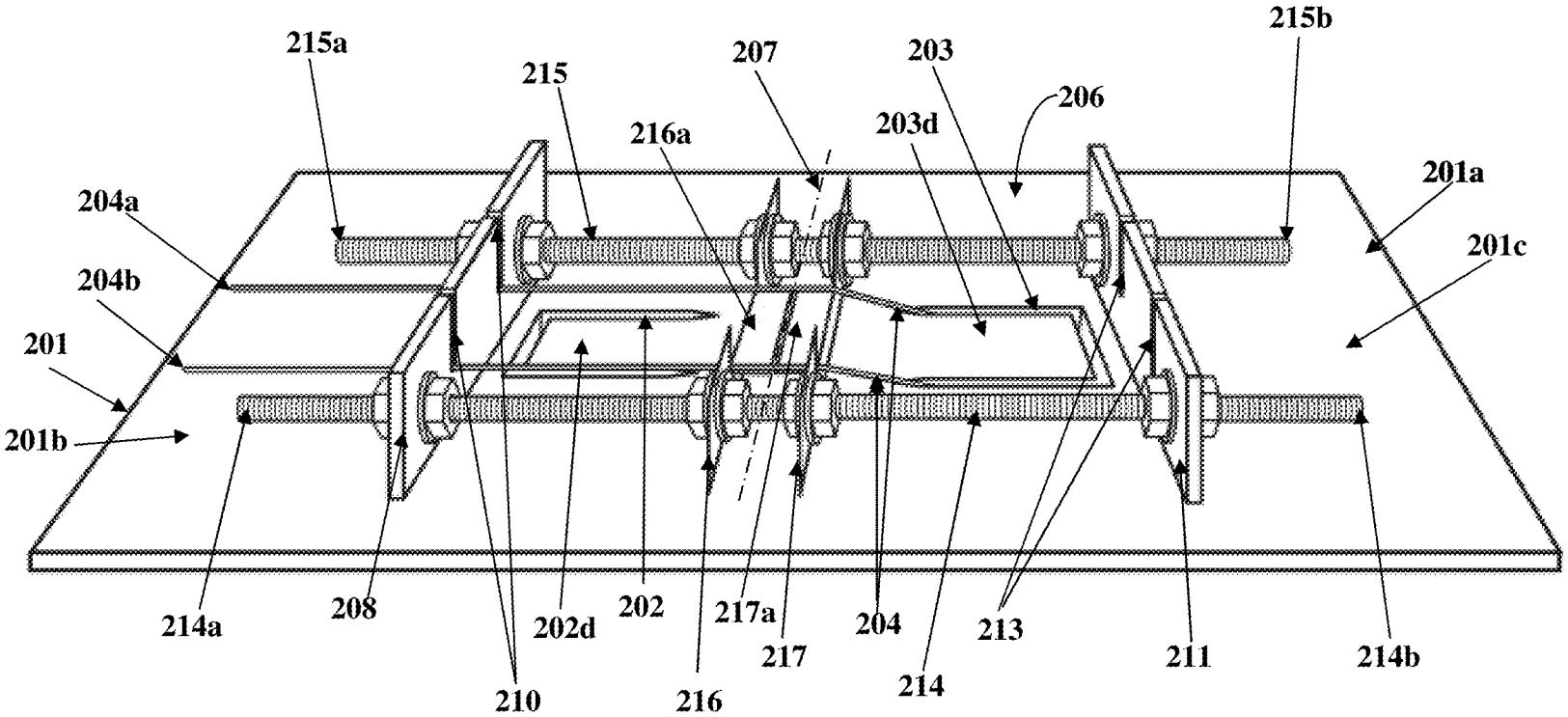
FIG. 7 exemplarily illustrates a top perspective view showing a tension bearing member extending from one of the anchoring grooves created on the surface of the first object, via one of the mold end members of the constrained assembly.
Figure 8:
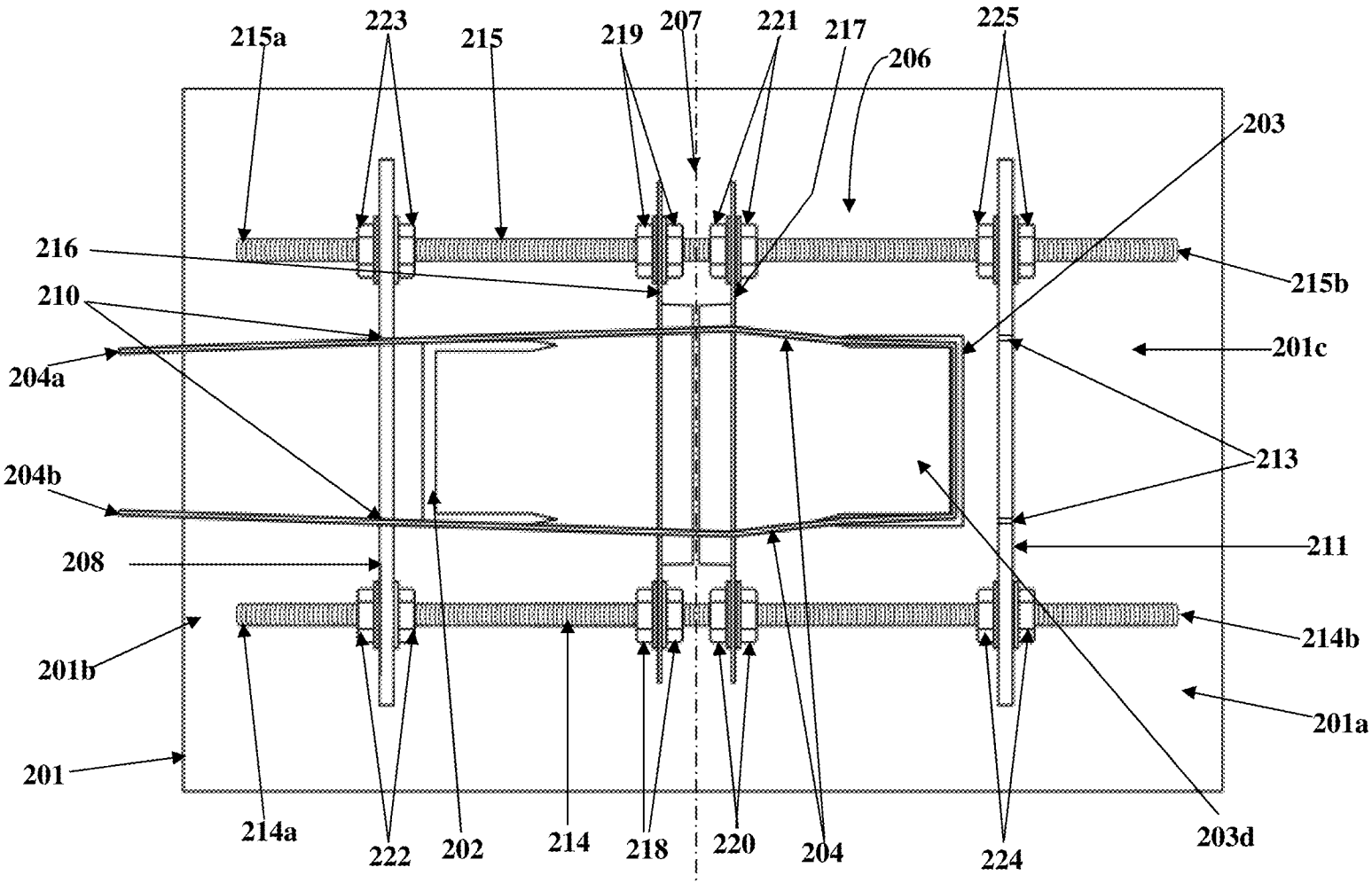
FIG. 8 exemplarily illustrates a top plan view showing the tension bearing member extending from the anchoring groove via the mold end member shown in FIG. 7.

FIGS. 7-8 exemplarily illustrate a top perspective view and a top plan view respectively, showing a tension bearing member 204 extending from the anchoring groove 203 created on the surface 201*a* of the first object 201, via the mold end member 208 of the constrained assembly 206. After the anchoring grooves 202 and 203 are created on the surface 201*a* of the first object 201 and the constrained assembly 206 is positioned on the surface 201*a* of the first object 201 as exemplarily illustrated in FIGS. 3-4, the tension bearing member 204 is anchored in the tab 203*d* of the anchoring groove 203 created by cutting the linear section 203*a* and the perpendicular sections 203*b* and 203*c* of the anchoring groove 203 exemplarily illustrated in FIG. 3. The tension bearing member 204 is looped around the tab 203*d* of the anchoring groove 203 and extended to pass over the wire deflector plates 217 and 216 and then through the slits 210 in the mold end member 208 along the length of the threaded members 214 and 215 of the constrained assembly 206. The ends 204*a* and 204*b* of the tension bearing member 204 extend beyond the mold end member 208. The tension bearing member 204 is threaded over the pair of wire deflector plates 217 and 216 prior to passing through the slits 210 in the mold end member 208. The tension bearing member 204 is anchored in the anchoring groove 203 at the opposing section 201*c* of the surface 201*a* of the first object 201 and extended in an opposing direction as exemplarily illustrated in FIGS. 7-8.

Figure 9:
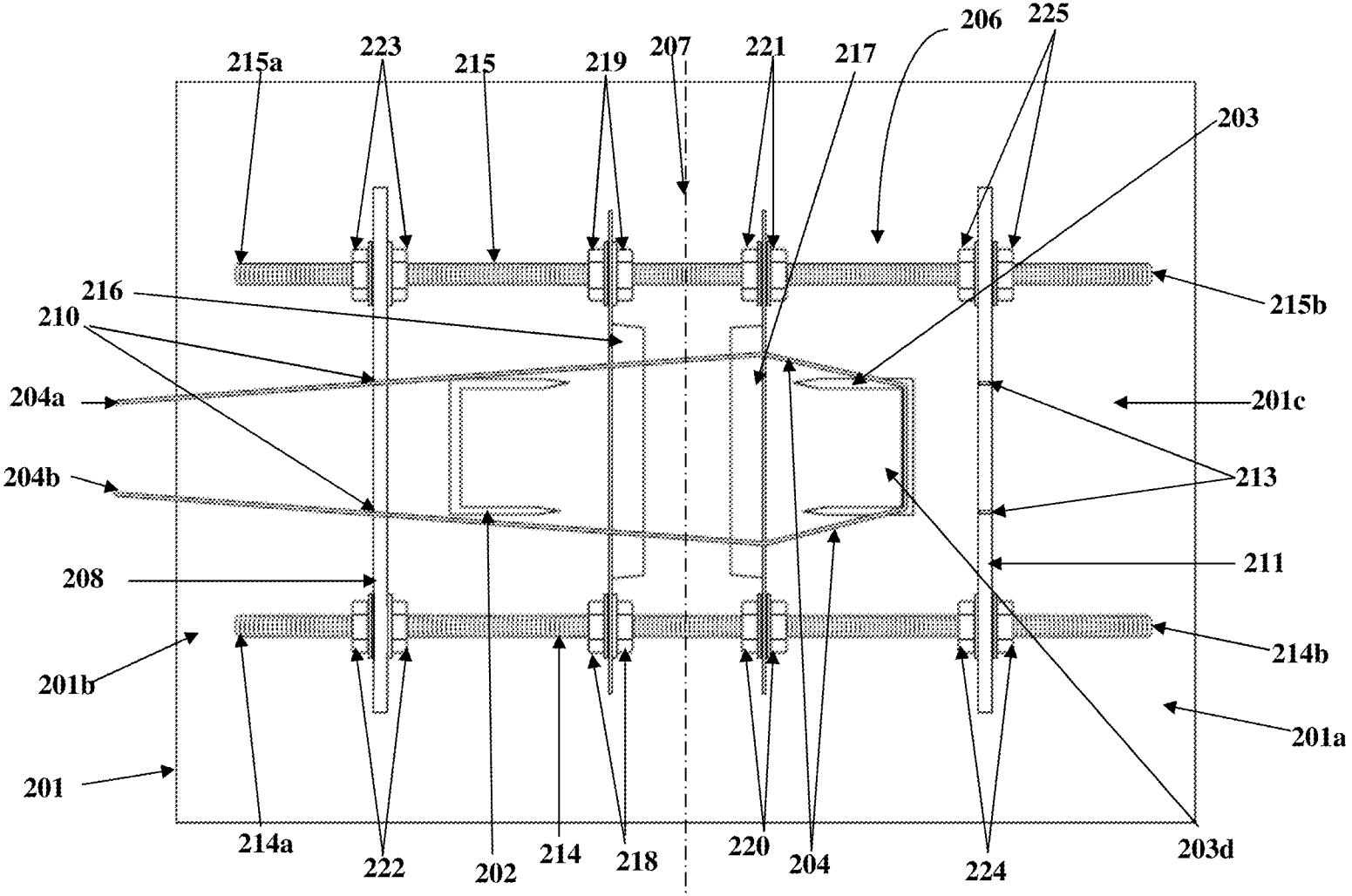
FIG. 9 exemplarily illustrates a top plan view showing an embodiment of extending one of the tension bearing members from one of the anchoring grooves created on the surface of the first object, via one of the mold end members of the constrained assembly.

FIG. 9 exemplarily illustrates a top plan view showing an embodiment of extending the tension bearing member 204 from the anchoring groove 203 created on the surface 201*a* of the first object 201, via the mold end member 208 of the constrained assembly 206. In an embodiment, the anchoring grooves 202 and 203 are cut with a shallow depth in the first object 201. As exemplarily illustrated in FIG. 9, the tension bearing member 204 is anchored in the anchoring groove 203 where the depth of the anchoring groove 203 is shallow. For example, the tension bearing member 204 is engaged with the side of the tab 203*d* for about a sixteenth of an inch, that is, 0.06", because the depth of the anchoring groove 203 is merely an eighth of an inch, that is, 0.125". The tension bearing member 204 is threaded over the pair of wire deflector plates 217 and 216 and passed through the slits 210 in the mold end member 208. In this embodiment, the wire deflector plates 216 and 217 are spaced a distance apart symmetrically about the central line 207 between the mold end members 208 and 211. The distance between the wire deflector plates 216 and 217 is selected based on the size of the molded attachment block 1601 exemplarily illustrated in FIGS. 16A-16B, to be created. As exemplarily illustrated in FIG. 9, the wire deflector plates 216 and 217 are separated by a distance for creating a long molded attachment block 1601.

Figure 10:
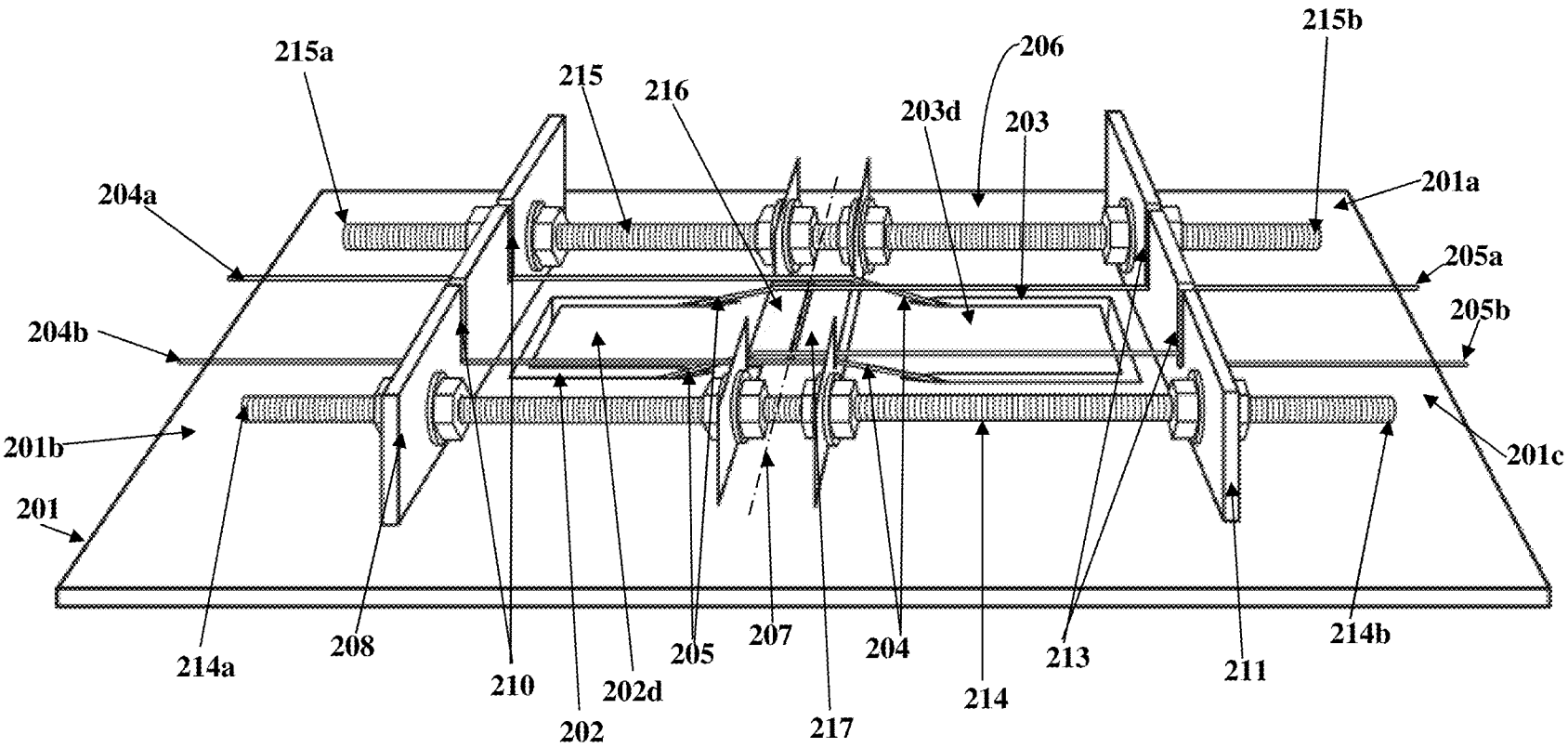
FIG. 10 exemplarily illustrates a top perspective view showing the tension bearing members extending from the anchoring grooves in opposing directions via the mold end members of the constrained assembly.

FIG. 10 exemplarily illustrates a top perspective view showing the tension bearing members 204 and 205 extending from the anchoring grooves 203 and 202 in opposing directions via the mold end members 208 and 211 of the constrained assembly 206 respectively. After the tension bearing member 204 is anchored in the anchoring groove 203 and extended from the anchoring groove 203 in one direction to pass through the slits 210 of the mold end member 208, the tension bearing member 205 is anchored in the anchoring groove 202 and extended from the anchoring groove 202 in an opposing direction to pass through the slits 213 of the mold end member 211 in a manner similar to extending the tension bearing member 204 anchored in the anchoring groove 203 exemplarily illustrated in FIGS. 7-8. The tension bearing member 205 is anchored in the tab 202*d* of the anchoring groove 202 created by cutting the linear section 202*a* and the perpendicular sections 202*b* and 202*c* of the anchoring groove 202 exemplarily illustrated in FIG. 3. The tension bearing member 205 is looped around the tab 202*d* of the anchoring groove 202 and extended to pass over the wire deflector plates 216 and 217 and then through the slits 213 in the mold end member 211 along the length of the threaded members 214 and 215 of the constrained assembly 206. The tension bearing member 205 is anchored by the tab 202*d* of the anchoring groove 202 at the opposing section 201*b* on the surface 201*a* of the first object 201 and extended in a direction opposing the direction of extension of the tension bearing member 204 as exemplarily illustrated in FIG. 10. The ends 205*a* and 205*b* of the tension bearing member 205 extend beyond the mold end member 211. The tension bearing member 205 is threaded over the pair of wire deflector plates 216 and 217 and passed through the slits 213 in the mold end member 211.

As the tension bearing member 204 extends from the anchoring groove 203 to pass through the slits 210 in the mold end member 208, the tension bearing member 204 circumscribes the tension bearing member 205 that extends from the anchoring groove 202 to pass through the slits 213 in the mold end member 211. As exemplarily illustrated in FIG. 10, a portion of the tension bearing member 205 from the anchoring groove 202 to the wire deflector plates 216 and 217 is positioned underneath the opposing tension bearing member 204 from the anchoring groove 203. That is, a portion of the tension bearing member 205 is positioned physically below a portion of the tension bearing member 204 that is between the wire deflector plate 216 and the mold end member 208. The portion of the tension bearing member 205 that emerges from the anchoring groove 202 and encounters the wire deflector plate 216 is positioned below the other tension bearing member 204. Conversely, a portion of the tension bearing member 204 while leaving the wire deflector plate 217 and continuing towards the slits 210 in the mold end member 208 is positioned above the other tension bearing member 205. Similarly, the portion of the tension bearing member 204 that emerges from the anchoring groove 203 and encounters the wire deflector plate 217 is positioned below the other tension bearing member 205. Conversely, a portion of the tension bearing member 205 while leaving the wire deflector plate 216 and continuing towards the slits 213 in the mold end member 211 is positioned above the other tension bearing member 204. The ends 204*a* and 204*b* of the tension bearing member 204 extending beyond the mold end member 208 are tied together. Similarly, the ends 205*a* and 205*b* of the tension bearing member 205 extending beyond the mold end member 211 are tied together. The tension bearing members 204 and 205 extend from the anchoring grooves 203 and 202 respectively, in opposing directions along the length of the constrained assembly 206.

Figure 11:
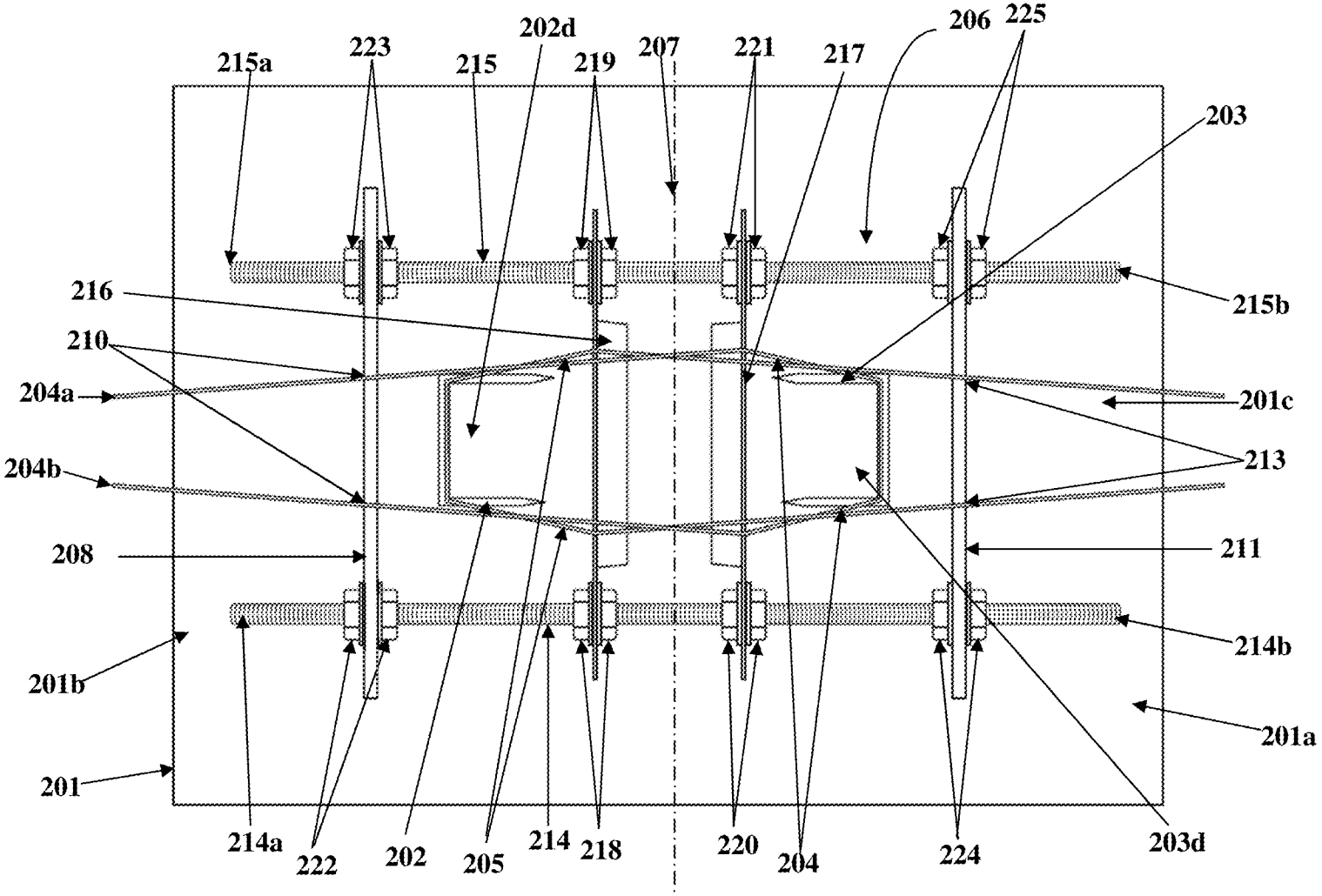
FIG. 11 exemplarily illustrates a top plan view showing an embodiment of extending the other tension bearing member from the other anchoring groove created on the surface of the first object, via the other mold end member.

FIG. 11 exemplarily illustrates a top plan view showing an embodiment of extending the other tension bearing member 205 from the other anchoring groove 202 created on the surface 201*a* of the first object 201, via the other mold end member 211. In this embodiment similar to the embodiment exemplarily illustrated in FIG. 9, the anchoring grooves 202 and 203 are cut with a shallow depth in the first object 201. As exemplarily illustrated in FIG. 11, the tension bearing member 205 is anchored in the anchoring groove 202 that is shallow. For example, the tension bearing member 205 is engaged with the sides of the tab 202*d* for about a sixteenth of an inch, that is, 0.06", because the depth of the anchoring groove 202 is merely an eighth of an inch, that is, 0.125". The tension bearing member 205 is threaded over the pair of wire deflector plates 216 and 217 and passed through the slits 213 in the mold end member 211. In this embodiment, the wire deflector plates 216 and 217 are spaced a large distance apart about the central line 207 between the mold end members 208 and 211 as disclosed in the detailed description of FIG. 9.

Figure 12:
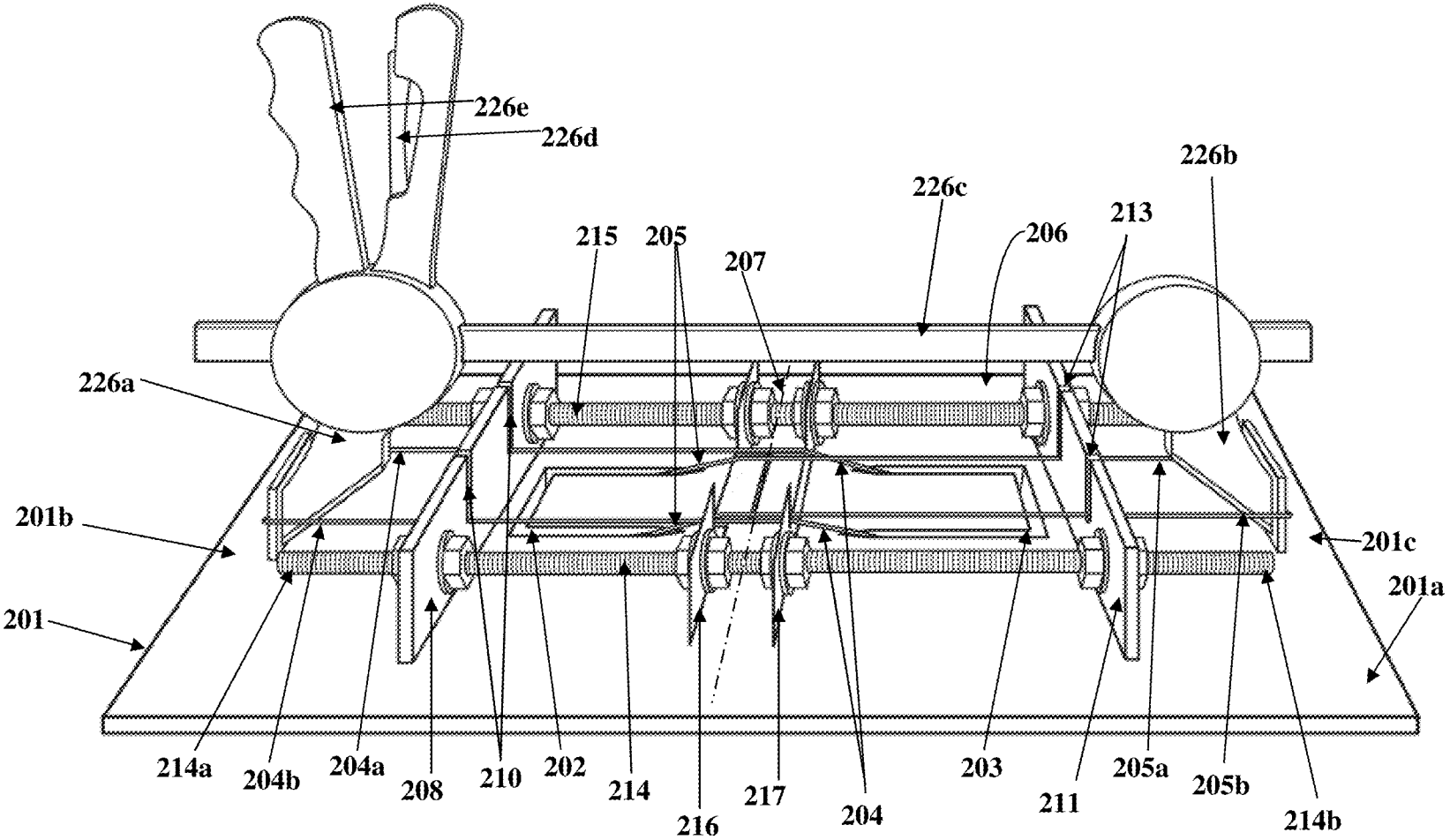
FIG. 12 exemplarily illustrates a top perspective view showing a tensioning device generating tension in the extended tension bearing members.

FIG. 12 exemplarily illustrates a top perspective view showing a tensioning device 226 generating tension in the extended tension bearing members 204 and 205. The tensioning device 226 is, for example, a trigger clamp as exemplarily illustrated in FIG. 12. The tensioning device 226 comprises two jaws, namely, a movable jaw 226*a* and a stationary jaw 226*b*, and a rail 226*c*. The movable jaw 226*a* and the stationary jaw 226*b* are positioned perpendicular to the rail 226*c* of the tensioning device 226. The movable jaw 226*a* of the tensioning device 226 slides along the rail 226*c* of the tensioning device 226. The stationary jaw 226*b* of the tensioning device 226 is statically attached to the rail 226*c*. The ends 204*a* and 204*b* of the tension bearing member 204 are tied and looped around the movable jaw 226*a* of the tensioning device 226 proximal to the opposing section 201*b* of the first object 201. The ends 205*a* and 205*b* of the tension bearing member 205 are tied and looped around the stationary jaw 226*b* of the tensioning device 226 proximal to the opposing section 201*c* of the first object 201. With a press of a quick release lever button 226*d* of the tensioning device 226, the movable jaw 226*a* of the tensioning device 226 can be moved and slid towards the stationary jaw 226*b*. A press of a trigger button 226*e* of the tensioning devices 226 moves the movable jaw 226*a* away from the stationary jaw 226*b*.

With each press of the trigger button 226*e* of the tensioning device 226, the stationary jaw 226*b* and the movable jaw 226*a* move further apart from each other. As the distance between the stationary jaw 226*b* and the movable jaw 226*a* is increased, the tension bearing members 204 and 205 are pulled in opposing directions, thereby generating a tension in the tension bearing members 204 and 205. The tension bearing members 204 and 205 under the generated tension exert a downward pressure on the wire deflector plates 216 and 217 of the constrained assembly 206, thereby positioning the constrained assembly 206 firmly on the first object 201. The downward pressure on the wire deflector plates 216 and 217 tends to incline the mold end members 208 and 211 inwardly towards the anchoring grooves 202 and 203 respectively. The amount of inclination of the mold end members 208 and 211 inwardly towards the anchoring grooves 202 and 203 respectively, is a function of the thickness of the mold end members 208 and 211 and size of the openings 209 and 212 in the mold end members 208 and 211 respectively, that engage the threaded members 214 and 215. The inclination of the mold end members 208 and 211 is mitigated by the pair of mold side members 227 and 228 positioned on the surface 201*a* of the first object 201 perpendicular to the mold end members 208 and 211 of the constrained assembly 206 as exemplarily illustrated in FIG. 13.

Figure 13:
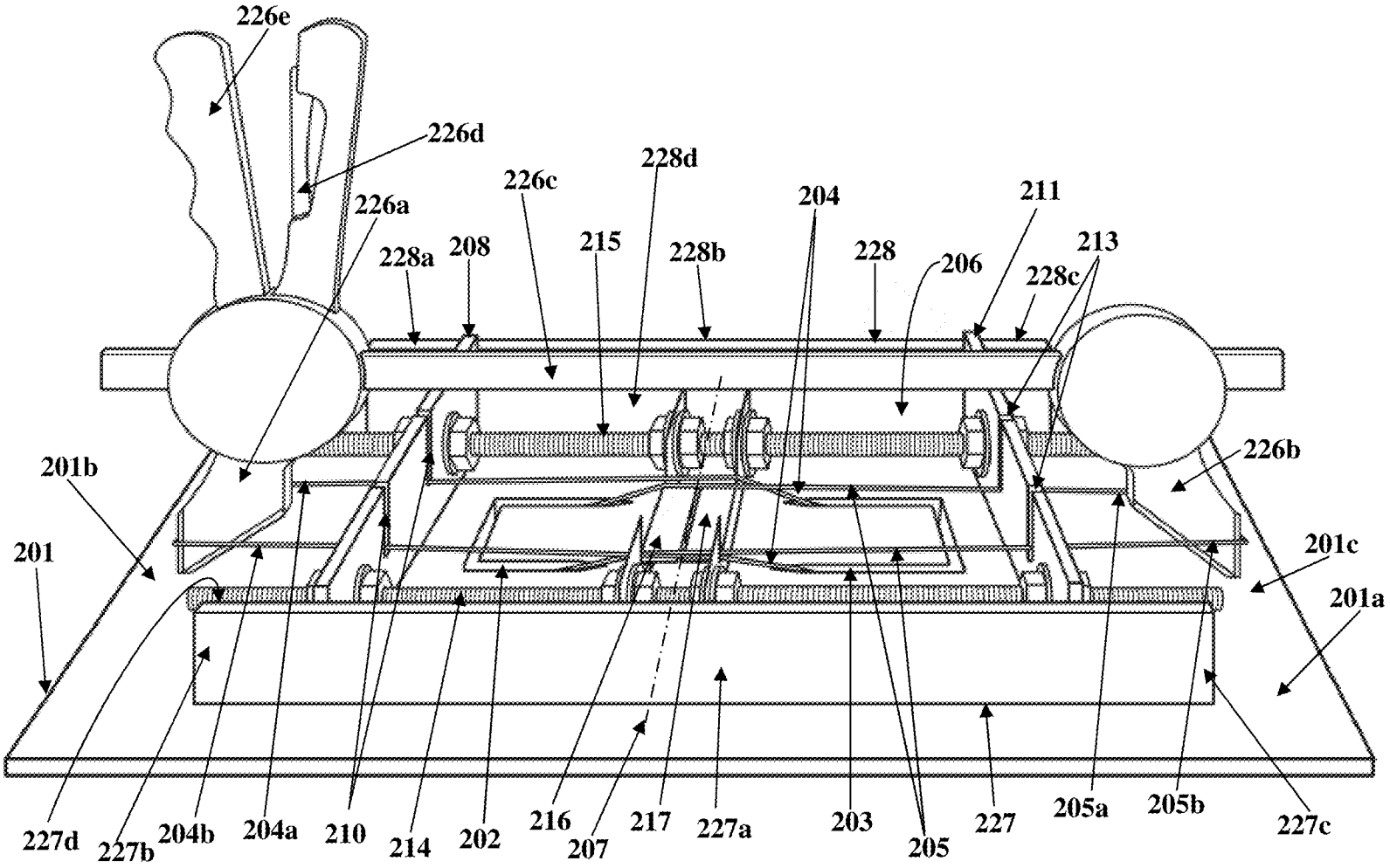
FIG. 13 exemplarily illustrates a top perspective view showing mold side members positioned perpendicular to the mold end members and along a length of the constrained assembly on the surface of the first object to create the assembly shown in FIG. 2.

FIG. 13 exemplarily illustrates a top perspective view showing the mold side members 227 and 228 positioned perpendicular to the mold end members 208 and 211 and along the length of the constrained assembly 206 on the surface 201*a* of the first object 201 to create the assembly 200 shown in FIG. 2. The mold side members 227 and 228 are positioned perpendicular to the mold end members 208 and 211 and are positioned along the length of the constrained assembly 206. The mold side members 227 and 228 are longer in length than the distance between the mold end members 208 and 211 on the surface 201*a* of the first object 201. The mold side members 227 and 228 are made of a metallic material. In an embodiment where the viscous liquid 1501 to be poured into the assembly 200 exemplarily illustrated in FIG. 15, is concrete or soap, a non-stick coating is applied on inner surfaces 227*d* and 228*d* of the mold side members 227 and 228 facing the threaded members 214 and 215 respectively, for easy removal of the mold side members 227 and 228 from the molded attachment block 1601 exemplarily illustrated in FIGS. 16A-16B, after the viscous liquid 1501 cures and hardens. In an embodiment, a metallic material cover (not shown) is attached to the mold end members 208 and 211 and/or the mold side members 227 and 228. In an embodiment, the mold side members 227 and 228 are of the same height as the mold end members 208 and 211. The mold side members 227 and 228 constrict the constrained assembly 206 using the clamping devices 229 and 230 removably positioned on the mold side members 227 and 228 as exemplarily illustrated in FIG. 2 and as disclosed in the detailed description of FIG. 14. The clamping devices 229 and 230 are, for example, trigger clamps. In an embodiment, the clamping devices 229 and 230 temporarily attach the mold side members 227 and 228 to the mold end members 208 and 211.

FIG. 14 exemplarily illustrates a top plan view of an embodiment of the assembly 200 shown in FIG. 2. As exemplarily illustrated in FIG. 14, the tension bearing members 204 and 205 are anchored in the anchoring grooves 203 and 202 respectively and engage the sides of the tabs 203*d* and 202*d* of the anchoring grooves 203 and 202 respectively, for example, for merely a sixteenth of an inch, because the depth of the anchoring grooves 203 and 202 is shallow as disclosed in the detailed description of FIG. 9 and FIG. 11. The tension bearing members 204 and 205 are threaded over the pair of wire deflector plates 217 and 216 and passed through the slits 210 and 213 in the mold end members 208 and 211 respectively. In the embodiment exemplarily illustrated in FIG. 14, the wire deflector plates 216 and 217 are separated by a large distance for creation of a long molded attachment block 1601 exemplarily illustrated in FIGS. 16A-16B. The tension bearing members 204 and 205 are clamped between small bolt assemblies 231 and 232 respectively, within the constrained assembly 206, to hold the tension generated in the tension bearing members 204 and 205.

As exemplarily illustrated in FIG. 2 and FIG. 14 and as disclosed in the detailed description of FIG. 13, the clamping devices 229 and 230 are removably positioned on the mold side members 227 and 228. The clamping devices 229 and 230 comprise movable jaws 229*a* and 230*a* respectively, and stationary jaws 229*b* and 230*b* respectively, as exemplarily illustrated in FIG. 2 and FIGS. 14-15. The movable jaws 229*a* and 230*a* are movable with respect to the stationary jaws 229*b* and 230*b* respectively. The stationary jaws 229*b* and 230*b* are integrated with rails 229*c* and 230*c* of the clamping devices 229 and 230 respectively. The movable jaws 229*a* and 230*a* of the clamping devices 229 and 230 respectively, are slidably engaged with the rails 229*c* and 230*c* of the clamping devices 229 and 230 respectively. As exemplarily illustrated in FIG. 14, the movable jaws 229*a* and 230*a* of the clamping devices 229 and 230 respectively, are removably positioned on an outer surface 227*a* of the mold side member 227 at opposing ends 227*b* and 227*c* of the mold side member 227, and the stationary jaws 229*b* and 230*b* of the clamping devices 229 and 230 respectively, are positioned on an outer surface 228*a* of the mold side member 228 at opposing ends 228*b* and 228*c* of the mold side member 228. That is, the movable jaw 229*a* of the clamping device 229 is positioned at one end 227*b* of the mold side member 227 on the outer surface 227*a* of the mold side member 227, and the stationary jaw 229*b* of the clamping device 229 is positioned at one end 228*b* of the mold side member 228 on the outer surface 228*a* of the mold side member 228. Similarly, the movable jaw 230*a* of the clamping device 230 is positioned at the opposing end 227*c* of the mold side member 227 on the outer surface 227*a* of the mold side member 227, and the stationary jaw 230*b* of the clamping device 230 is positioned at the opposing end 228*c* of the mold side member 228 on the outer surface 228*a* of the mold side member 228.

With a press of quick release lever buttons 229*d* and 230*d* of the clamping devices 229 and 230 respectively, the movable jaws 229*a* and 230*a* of the clamping devices 229 and 230 slide away from the stationary jaws 229*b* and 230*b* respectively. A press of trigger buttons 229*e* and 230*e* of the clamping devices 229 and 230 respectively, tightens the movable jaws 229*a* and 230*a* and the stationary jaws 229*b* and 230*b*. With each press of the trigger buttons 229*e* and 230*e* of the clamping devices 229 and 230 respectively, the movable jaws 229*a* and 230*a* and the stationary jaws 229*b* and 230*b* of the clamping devices 229 and 230 respectively, move towards each other, thereby pushing the mold side members 227 and 228 towards the mold end members 208 and 211 of the constrained assembly 206. The mold side members 227 and 228 sandwich the mold end members 208 and 211 and a frictional force between the mold side members 227 and 228 and the mold end members 208 and 211 holds the mold end members 208 and 211 perpendicular to the surface 201*a* of the first object 201. In embodiments where the tension bearing members 204 and 205 are under substantially high tensions, the mold side members 227 and 228 comprise receptacles (not shown) that mate with opposing ends of the mold end members 208 and 211 to hold the mold end members 208 and 211 perpendicular to the surface 201*a* of the first object 201.

FIG. 15 exemplarily illustrates a top perspective view showing pouring of a viscous liquid 1501 on the assembly 200 comprising the constrained assembly 206, the extended tension bearing members 204 and 205, the anchoring grooves 202 and 203, and the bolt assemblies 231 and 232 positioned above the surface 201*a* of the first object 201, for creating the molded attachment block 1601 exemplarily illustrated in FIGS. 16A-16B. The extended tension bearing members 204 and 205 that are under the generated tension are clamped between at least four bolt assemblies 231 and 232 respectively. As exemplarily illustrated in FIG. 2 and FIG. 15, the tension bearing members 204 and 205 are clamped between the bolt assemblies 231 and 232 respectively, after passing over the wire deflector plates 217 and 216 and prior to passing through the slits 210 and 213 in the mold end members 208 and 211 respectively. The bolt assemblies 231 and 232 comprise bolt members 231*a* and 232*a*, upper washers 231*b* and 232*b*, lower washers 231*c* and 232*c*, and nuts 231*d* and 232*d* respectively, as exemplarily illustrated in FIG. 15. The tension bearing member 204 is clamped between the upper washer 231*b* and the lower washer 231*c* of each of the two bolt assemblies 231. Similarly, the tension bearing member 205 is clamped between the upper washer 232*b* and the lower washer 232*c* of each of the two bolt assemblies 232. The tension bearing members 204 and 205 are squeezed and pressed between the upper washers 231*b* and 232*b* and the lower washers 231*c* and 232*c* by tightening the nuts 231*d* and 232*d* on the bolt members 231*a* and 232*a* of the bolt assemblies 231 and 232 respectively. The nuts 231*d* and 232*d* are tightened on the bolt members 231*a* and 232*a* of the bolt assemblies 231 and 232 respectively, by screwably threading the nuts 231*d* and 232*d* along the threads of the bolt members 231*a* and 232*a* of the bolt assemblies 231 and 232 respectively. The upper washers 231*b* and 232*b* and the lower washers 231*c* and 232*c* of the bolt assemblies 231 and 232 respectively, distribute load of the bolt members 231*a* and 232*a*. The bolt members 231*a* and 232*a* with the nuts 231*d* and 232*d* tighten the tension bearing members 204 and 205 respectively, to prevent rotation and lateral movement of the tension bearing members 204 and 205 after the poured viscous liquid 1501 hardens. The bolt members 231*a* and 232*a* are tightened by the respective nuts 231*d* and 232*d* to squeeze and press the tension bearing members 204 and 205 respectively, to grip the tension bearing members 204 and 205 under the generated tension after the viscous liquid 1501 hardens. The ends of the bolt members 231*a* and 232*a* of the bolt assemblies 231 and 232 respectively, suspend above the surface 201*a* of the first object 201.

The viscous liquid 1501 is, for example, one of concrete, thermoplastics, soap, wax, etc., and any combination thereof. The viscous liquid 1501 changes from a liquid state to a solid state on drying or cooling. That is, if concrete is used as the viscous liquid 1501, on drying, the concrete cures. In an embodiment where a thermoplastic is used as the viscous liquid 1501, on cooling, the thermoplastic hardens. The viscous liquid 1501, on solidifying, preserves the tension generated in the tension bearing members 204 and 205 and consequently preserves and withstands downward pressure on the constrained assembly 206. The viscous liquid 1501 is poured using a container 1502, for example, a hopper in a region defined by the mold end members 208 and 211 and the mold side members 227 and 228, on the threaded members 214 and 215, the anchoring grooves 202 and 203, the wire deflector plates 216 and 217, the extended tension bearing members 204 and 205, the deflector connectors 218, 219, 220, and 221, the mold end connectors 222, 223, 224, and 225, and the four bolt assemblies 231 and 232. In an embodiment, the viscous liquid 1501 is also poured and cured on the mold end members 208 and 211 for permanently retaining the mold end members 208 and 211 within the molded attachment block 1601. In an embodiment, the viscous liquid 1501 is also poured and cured on the mold side members 227 and 228 for permanently retaining the mold side members 227 and 228 within the molded attachment block 1601.

After the viscous liquid 1501 is cured, the viscous liquid 1501 that has transformed to a solid state surrounds and holds the bolt assemblies 231 and 232 that clamped the extended tension bearing members 204 and 205 firmly, thereby preserving the tension in the tension bearing members 204 and 205. The tensioning device 226 is released after the viscous liquid 1501 is cured. The clamping devices 229 and 230 are removed from being in contact with the mold side members 227 and 228. The mold side members 227 and 228 and in an embodiment, the mold end members 208 and 211 are also removed and the molded attachment block 1601 is created. The molded attachment block 1601 with the embedded threaded members 214 and 215 is mechanically created and attached on the surface 201*a* of the first object 201, and in an embodiment, allows attachment of second objects to the first object 201. In the embodiment where the viscous liquid 1501 is poured on the mold end members 208 and 211, the mold end members 208 and 211 are permanently retained within the molded attachment block 1601. In the embodiment where the viscous liquid 1501 is poured on the mold side members 227 and 228, the mold side members 227 and 228 are permanently retained within the molded attachment block 1601.

FIGS. 16A-16B exemplarily illustrate top perspective views of the molded attachment block 1601 created on curing of the poured viscous liquid 1501 shown in FIG. 15, showing opposing ends 214*a*, 214*b* and 215*a*, 215*b* of the threaded members 214 and 215 respectively, of the constrained assembly 206, extending from the molded attachment block 1601. As exemplarily illustrated in FIG. 16A, the ends 204*a*, 204*b* and 205*a*, 205*b* of the tension bearing members 204 and 205 respectively, and the opposing ends 214*a*, 214*b* and 215*a*, 215*b* of the threaded members 214 and 215 respectively, extend beyond the mold end members 208 and 211 and protrude outwardly. The tension bearing members 204 and 205, the threaded members 214 and 215, and the wire deflector plates 216 and 217 exemplarily illustrated in FIG. 2 and FIGS. 14-15, are permanently retained in the molded attachment block 1601. The ends 204*a*, 204*b* and 205*a*, 205*b* of the tension bearing members 204 and 205 respectively, protruding from the molded attachment block 1601 exemplarily illustrated in FIG. 16A, are cut using a cutter (not shown) to generate the molded attachment block 1601 with only the threaded members 214 and 215, for example, the threaded rods extending from the molded attachment block 1601 as exemplarily illustrated in FIG. 16B. The threaded members 214 and 215 run through the length of the molded attachment block 1601 and protrude a distance from the molded attachment block 1601 appropriate for one or more other second objects, for example, brackets, hinges, etc., to be attached to the first object 201. The threaded members 214 and 215 extend the length of the molded attachment block 1601 between the mold end members 208 and 211 and beyond the molded attachment block 1601.

The tension in the tension bearing members 204 and 205 is preserved by the cured viscous liquid 1501 to produce a force that presses the molded attachment block 1601 against the surface 201*a* of the first object 201, thereby allowing metallic mechanical second objects to be attached to non-metallic first objects. The attachment of the mold attachment block 1601 to the surface 201*a* of the first object 201 stores the tension in the tension bearing members 204 and 205 in a manner where inadvertent release of the stored tension in the tension bearing members 204 and 205 does not take place. In an embodiment, the surface 201*a* of the first object 201 is covered with a metallic material in entirety except for the anchoring grooves 202 and 203. In this embodiment, the mold side members 227 and 228 are attached to the metallic surface 201*a* of the first object 201 and the viscous liquid 1501 is poured and cured. In this embodiment, the mold side members 227 and 228 are permanently retained within the molded attachment block 1601. In an embodiment, the molded attachment block 1601 further comprises mechanical attachments, for example, a hook, a screw, rails, etc., for attaching one or more second objects, for example, hinges, brackets, etc., to the surface 201*a* of the first object 201. In an embodiment, the assembly 200 exemplarily illustrated in FIG. 2, constituting the molded attachment block 1601 is partially made of a metallic material. For example, the mold end members 208 and 211 and the mold side members 227 and 228 are made of a plastic material, while the extended tension bearing members 204 and 205 and the bolt assemblies 231 and 232 are made of the metallic material. In an example, for a first object 201 such as a tile made of a ceramic material, mold end members 208 and 211 made of a plastic material are used. The plastic mold end members 208 and 211 are used to preclude adherence of the viscous liquid 1501 to the plastic mold end members 208 and 211 when the viscous liquid 1501 cures, for allowing removal of the plastic mold end members 208 and 211 after creation of the molded attachment block 1601. In another example, the mold end members 208 and 211 are made of a steel material comprising a non-stick coating. In an embodiment, the elements of the assembly 200, for example, the mold end members 208 and 211, the mold side members 227 and 228, etc., can be replaced either partially or entirely with metal elements that remain with the first object 201 and can be modified to accommodate any mechanical attachments desired.

Figure 17:
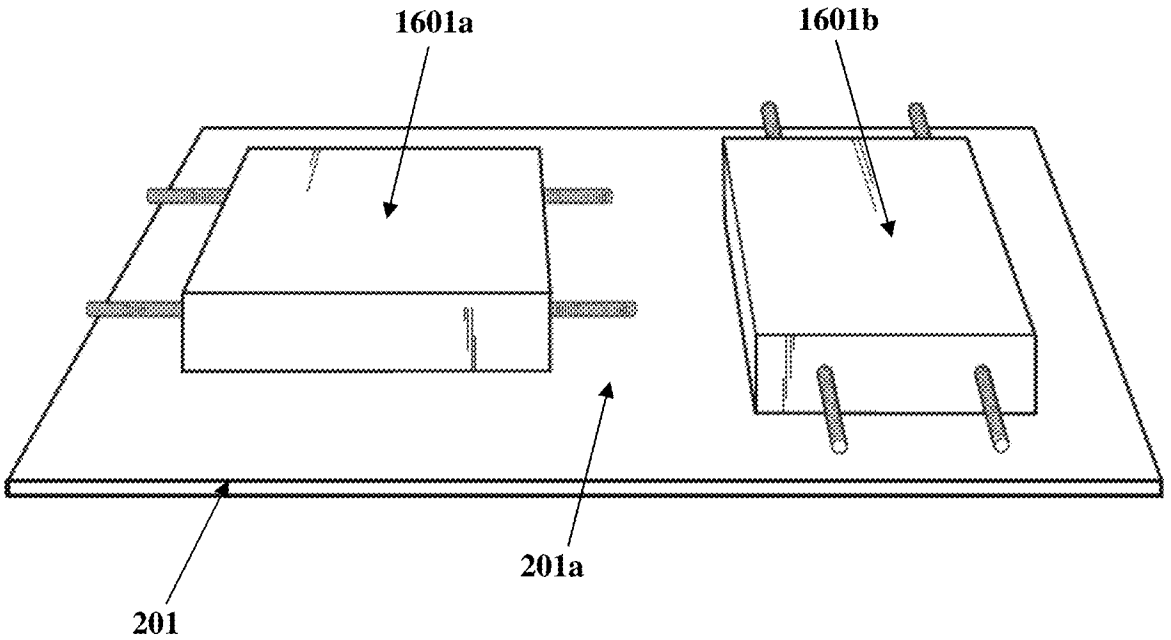
FIG. 17 exemplarily illustrates a top perspective view showing multiple molded attachment blocks created on a surface of a first object made of a first material for attaching to one or more second objects made of one or more second materials dissimilar to the first material of the first object.

FIG. 17 exemplarily illustrates a top perspective view showing multiple molded attachment blocks 1601*a* and 1601*b* created on a surface 201*a* of a first object 201, for example, a tile, made of a first material for attaching to one or more second objects (not shown) made of one or more second materials dissimilar to the first material of the first object 201. For creating the molded attachment blocks 1601*a* and 1601*b*, some of the components of the assembly 200 exemplarily illustrated in FIG. 2, for example, the mold end members 208 and 211 and the threaded members 214 and 215 of the constrained assembly 206, the mold side members 227 and 228, etc., are shared with another similar assembly 200. The molded attachment blocks 1601*a* and 1601*b* can be created in different orientations on the first object 201 as exemplarily illustrated in FIG. 17. Consider an example where the mold end members 208 and 211 or the threaded members 214 and 215 of the constrained assembly 206 are shared by two or more molded attachment blocks 1601*a* and 1601*b* on two different first objects, for example, two tiles. The molded attachment blocks 1601*a* and 1601*b* formed using the shared mold end members 208 and 211 or the shared threaded members 214 and 215 on the two first objects join the two first objects to each other without any bonding material. In an embodiment, the molded attachment blocks 1601*a* and 1601*b* are created independently on the surface 201*a* of the first object 201.

Figure 18:
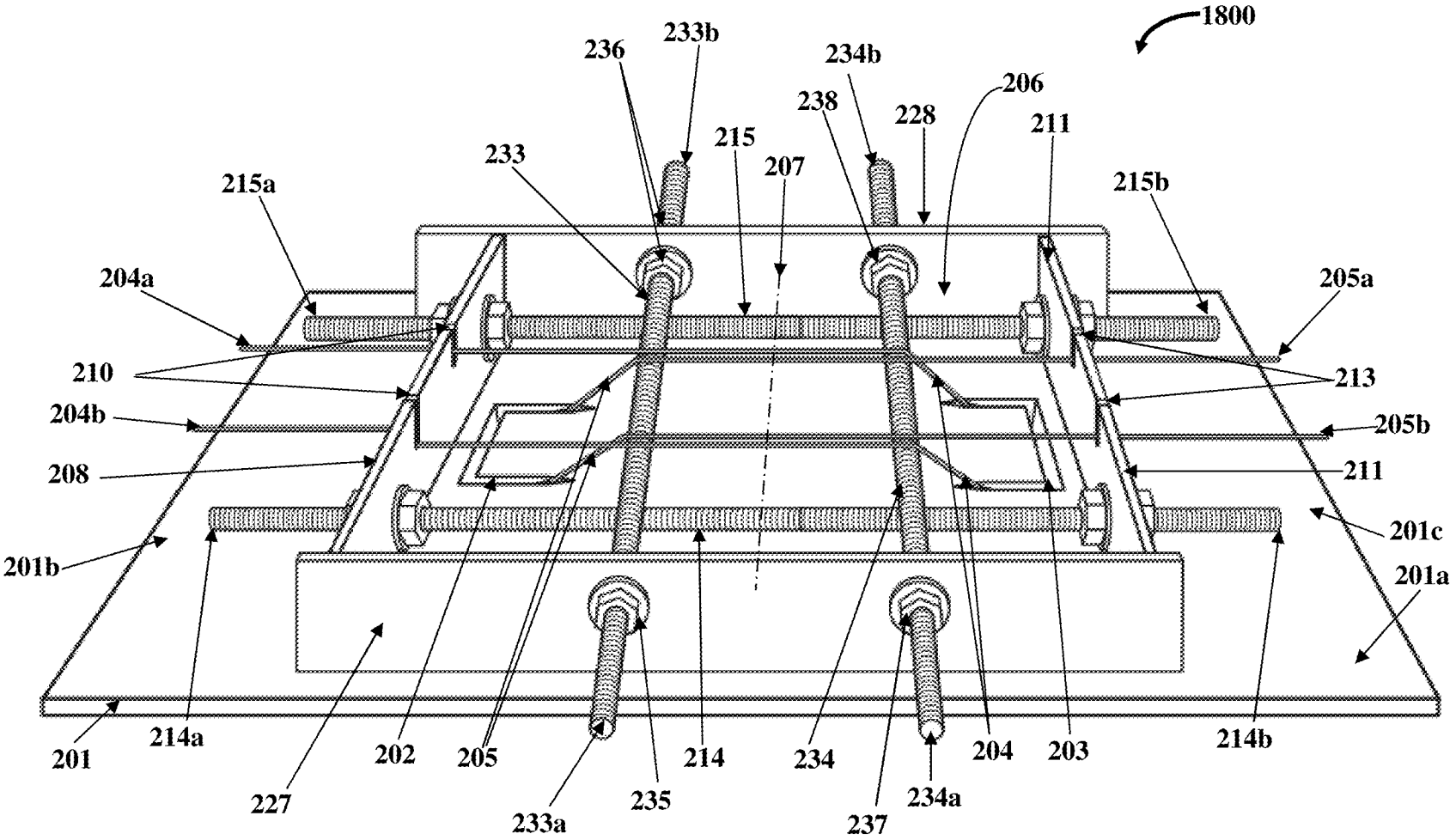
FIG. 18 exemplarily illustrates a top perspective view of an embodiment of the assembly for creating a multi-tiered molded attachment block on a surface of a first object made of a first material for attaching to one or more second objects made of one or more second materials dissimilar to the first material of the first object.

FIG. 18 exemplarily illustrates a top perspective view of an embodiment of the assembly 200 exemplarily illustrated in FIG. 2, herein referred to as the assembly 1800, for creating a multi-tiered molded attachment block (not shown) on a surface 201*a* of a first object 201 made of a first material for attaching to one or more second objects made of one or more second materials dissimilar to the first material of the first object 201. As used herein, "multi-tiered molded attachment block" is a molded attachment block comprising multiple tiers of threaded members. In the multi-tiered molded attachment block disclosed herein, the wire deflector plates 216 and 217 of the constrained assembly 206 are replaced by at least two wire deflector threaded members 233 and 234. As exemplarily in FIG. 18, the constrained assembly 206 comprises a pair of wire deflector threaded members 233 and 234 positioned above the threaded members 214 and 215, for example, threaded rods, of the constrained assembly 206. The wire deflector threaded members 233 and 234 are, for example, reinforcement bars, rectangular tubes, round tubes, round bars, rectangular bars, channels, angles, etc. The two wire deflector threaded members 233 and 234 are perpendicularly engaged with the mold side members 227 and 228 in the assembly 1800 for creating the multi-tiered molded attachment block. The wire deflector threaded members 233 and 234 perpendicularly engage with the mold side members 227 and 228 using at least four deflector connectors 235, 236, 237, and 238 comprising nuts and washers. The wire deflector threaded members 233 and 234 are positioned parallel to the mold end members 208 and 211 of the constrained assembly 206 and are symmetrical about the central line 207 between the mold end members 208 and 211. The wire deflector threaded members 233 and 234 support and deflect the extended tension bearing members 204 and 205 firmly, thereby allowing creation of the multi-tiered molded attachment block.

The wire deflector threaded members 233 and 234 lie on top of and are, therefore, in contact with the threaded members 214 and 215 of the constrained assembly 206. The threaded members 214 and 215 and the mold end members 208 and 211 of the constrained assembly 206 form a first tier of the multi-tiered molded attachment block. The wire deflector threaded members 233 and 234, the extended tension bearing members 204 and 205, and the mold side members 227 and 228 act as threaded members, tension bearing members, and mold end members of a second tier of the multi-tiered molded attachment block respectively. As the extended tension bearing members 204 and 205 are tensioned, the extended tension bearing members 204 and 205 exert a downward force on the wire deflector threaded members 233 and 234 in the second tier, and the wire deflector threaded members 233 and 234 in the second tier in turn exert a downward force on the threaded members 214 and 215 in the first tier. The multi-tiered molded attachment block is compact as multiple tension bearing members are absent from the constrained assembly 206.

Similar to the creation of the molded attachment block 1601 from the assembly 200 exemplarily illustrated in FIG. 2, at least four bolt assemblies 231 and 232 (not shown in FIG. 18) are attached to and clamp the extended tension bearing members 204 and 205 at a position after either of the extended tension bearing members 204 and 205 crosses the wire deflector threaded members 233 and 234. After the bolt assemblies 231 and 232 are attached to the extended tension bearing members 204 and 205, a viscous liquid 1501 as exemplarily illustrated in FIG. 15, is poured and cured on the assembly 1800 comprising the first tier and the second tier for creating the multi-tiered molded attachment block. In the multi-tiered molded attachment block disclosed herein, the ends 214*a*, 215*a* and 214*b*, 215*b* of the threaded members 214 and 215 extend beyond the mold end members 208 and 211 respectively. Similarly, the ends 233*a*, 234*a* and 233*b*, 234*b* of the wire deflector threaded members 233 and 234 extend beyond the mold side members 227 and 228 respectively. The extended ends 214*a*, 215*a* and 214*b*, 215*b* of the threaded members 214 and 215 and the ends 233*a*, 234*a* and 233*b*, 234*b* of the wire deflector threaded members 233 and 234 allow attachment to one or more second objects, for example, brackets, hinges, etc., similar to the molded attachment block 1601. In an embodiment, the second objects attached to the multi-tiered molded attachment block at the ends 214*a*, 215*a* and 214*b*, 215*b* of the threaded members 214 and 215 and the ends 233*a*, 234*a* and 233*b*, 234*b* of the wire deflector threaded members 233 and 234 are perpendicular to and vertically offset from each other.

The foregoing examples have been provided merely for explanation and are in no way to be construed as limiting of the method and the molded attachment block 1601 disclosed herein. While the method and the molded attachment block 1601 have been described with reference to various embodiments, it is understood that the words, which have been used herein, are words of description and illustration, rather than words of limitation. Furthermore, although the method and the molded attachment block 1601 have been described herein with reference to particular means, materials, and embodiments, the method and the molded attachment block 1601 are not intended to be limited to the particulars disclosed herein; rather, the method and the molded attachment block 1601 extend to all functionally equivalent structures, methods and uses, such as are within the scope of the appended claims. While multiple embodiments are disclosed, it will be understood by those skilled in the art, having the benefit of the teachings of this specification, that the method and the molded attachment block 1601 disclosed herein are capable of modifications and other embodiments may be effected and changes may be made thereto, without departing from the scope and spirit of the method and the molded attachment block 1601 disclosed herein.

I claim:

1. A method for attaching a first object made of a first material to one or more second objects made of one or more of a plurality of second materials dissimilar to said first material of said first object without any bonding material, using a molded attachment block, said method comprising:

creating anchoring grooves at opposing sections on a surface of said first object made of said first material, wherein said anchoring grooves anchor tension bearing members on said first object;

positioning a constrained assembly comprising mold end members and threaded members, proximal to said created anchoring grooves at said opposing sections on said surface of said first object, said mold end members comprising openings for receiving and perpendicularly engaging opposing ends of said threaded members;

extending said tension bearing members from said created anchoring grooves in opposing directions along a length of said constrained assembly via said mold end members;

generating a tension in said extended tension bearing members using a tensioning device;

positioning mold side members perpendicular to said mold end members of said constrained assembly and along said length of said constrained assembly on said surface of said first object;

constricting said constrained assembly between said mold side members using clamping devices removably positioned on said mold side members;

clamping said extended tension bearing members under said generated tension between at least four bolt assemblies positioned above said surface of said first object within said constrained assembly for gripping said extended tension bearing members; and pouring and curing a viscous liquid on said constrained assembly, said extended tension bearing members, said anchoring grooves, and said at least four bolt assemblies for creating said molded attachment block with said opposing ends of said threaded members of said constrained assembly extending outwardly from said molded attachment block, wherein said extended opposing ends of said threaded members allow attachment of said one or more second objects made of said one or more of said second materials dissimilar to said first material of said first object to said surface of said first object without any said bonding material.

2. The method of claim 1, further comprising cutting ends of said tension bearing members extending outwardly from said created molded attachment block in said opposing directions.

3. The method of claim 1, wherein said anchoring grooves are created at locations symmetrical about a central line between said mold end members of said constrained assembly.

4. The method of claim 1, wherein each of said mold end members comprises slits for receiving said tension bearing members extending from said anchoring grooves in said opposing directions.

5. The method of claim 1, wherein said constrained assembly further comprises at least two wire deflector plates positioned parallel to said mold end members and connected to said threaded members symmetrically about a central line between said mold end members using at least four deflector connectors.

6. The method of claim 5, wherein each of said at least two wire deflector plates comprises a plate section and wing sections extending from opposing sides of said plate section, wherein said plate section deflects said extended tension bearing members, and wherein said wing sections are connected to said threaded members symmetrically about said central line between said mold end members using said at least four deflector connectors.

7. The method of claim 1, wherein said constrained assembly comprises at least two wire deflector threaded members positioned above said threaded members of said constrained assembly and perpendicularly engaged with said mold side members using at least four deflector connectors for supporting and deflecting said extended tension bearing members, thereby allowing creation of a multi-tiered molded attachment block, wherein said at least two wire deflector threaded members are symmetrical about a central line between said mold end members of said constrained assembly.

8. The method of claim 7, wherein said at least two wire deflector threaded members are one of reinforcement bars, rectangular tubes, round tubes, round bars, rectangular bars, channels, and angles.

9. The method of claim 1, wherein said cured viscous liquid preserves said generated tension in said tension bearing members and withstands downward pressure on said constrained assembly.

10. The method of claim 1, wherein said viscous liquid is one of concrete, thermoplastics, soap, wax, and any combination thereof.

11. The method of claim 1, further comprising removing said clamping devices and said mold side members from said created molded attachment block after said curing of said poured viscous liquid.

12. The method of claim 1, further comprising removing said mold end members of said constrained assembly from said created molded attachment block after said curing of said poured viscous liquid.

13. The method of claim 1, wherein said viscous liquid is poured and cured on said mold side members for permanently retaining said mold side members within said created molded attachment block.

14. The method of claim 1, wherein said threaded members of said constrained assembly are one of reinforcement bars, rectangular tubes, round tubes, round bars, rectangular bars, channels, and angles.

15. The method of claim 1, wherein said first object has a constant surface geometry.

* * * * *